US006171472B1

(12) United States Patent
Lokhandwala et al.

(10) Patent No.: US 6,171,472 B1
(45) **Date of Patent: *Jan. 9, 2001**

(54) SELECTIVE PURGE FOR REACTOR RECYCLE LOOP

(75) Inventors: Kaaeid A. Lokhandwala, Union City; Richard W. Baker, Palo Alto, both of CA (US)

(73) Assignee: Membrane Technology and Research, Inc., Menlo Park, CA (US)

( * ) Notice: Under 35 U.S.C. 154(b), the term of this patent shall be extended for 0 days.

This patent is subject to a terminal disclaimer.

(21) Appl. No.: 09/083,660

(22) Filed: May 22, 1998

(51) Int. Cl.[7] ..... C10G 45/00

(52) U.S. Cl. ..... 208/103; 208/100; 208/101; 208/102; 208/209; 208/264; 585/818

(58) Field of Search ..... 585/818; 208/100, 208/101, 102, 103, 209, 264

(56) References Cited

U.S. PATENT DOCUMENTS

| | | | | |
|---|---|---|---|---|
| 3,520,800 | * | 7/1970 | Forbes et al. | 208/101 |
| 4,212,726 | * | 7/1980 | Mayes | 208/101 |
| 4,362,613 | | 12/1982 | MacLean | 208/108 |
| 4,364,820 | * | 12/1982 | DeGraff et al. | 208/101 |
| 4,367,135 | | 1/1983 | Posey, Jr. | 208/108 |
| 4,457,834 | * | 7/1984 | Caspers et al. | 208/143 |
| 4,548,619 | | 10/1985 | Steacy | 55/16 |
| 4,654,063 | | 3/1987 | Auvil et al. | 62/18 |
| 4,836,833 | | 6/1989 | Nicholas et al. | 55/16 |
| 4,857,078 | | 8/1989 | Watler | 55/16 |
| 4,892,564 | | 1/1990 | Cooley | 55/16 |
| 4,963,165 | | 10/1990 | Blume et al. | 55/16 |
| 5,053,067 | | 10/1991 | Chretien | 62/24 |
| 5,082,481 | | 1/1992 | Barchas et al. | 62/23 |
| 5,082,551 | * | 1/1992 | Reynolds et al. | 208/100 |
| 5,157,200 | | 10/1992 | Mikkinen et al. | 585/803 |
| 5,271,835 | * | 12/1993 | Gorawara et al. | 208/228 |
| 5,332,424 | | 7/1994 | Rao et al. | 95/47 |
| 5,354,547 | | 10/1994 | Rao et al. | 423/650 |
| 5,435,836 | | 7/1995 | Anand et al. | 95/45 |
| 5,507,856 | | 4/1996 | Rao et al. | 95/50 |
| 5,634,354 | | 6/1997 | Howard et al. | 62/624 |
| 5,689,032 | | 11/1997 | Krause et al. | 585/802 |
| 5,785,739 | * | 7/1998 | Baker | 95/39 |

OTHER PUBLICATIONS

"Membrane Technology for Hydrocarbon Separation," Membrane Associates Ltd., No Date.

"Polymeric Gas Separation Membranes," Paul and Yampolski (eds.), No Date.

H. Yamashiro, "Plant Uses Membrane Separation," Hydrocarbon Processing, Jan. 1985.

H. Yamashiro et al., "Hydrogen Purification with Cellulose Acetate Membranes," presented at Europe–Japan Congress on Membranes and Membrane Processes, Jun. 18–21, 1984.

W.A. Bollinger et al., "Optimizing Hydrocracker Hydrogen," Chemical Engineering Progress, May, 1984.

J.M. Abrardo, "Hydrogen Technologies to Meet Refiners' Future Needs," Hydrocarbon Process, Feb. 1995.

W.A.Bollinger et al., "Prism™ Separators Optimize Hydrocracker Hydrogen," Paper presented at AIChE 1983 Summer National Meeting, Session No. 66, Aug. 29, 1983.

* cited by examiner

*Primary Examiner*—Marian C. Knode
*Assistant Examiner*—Nadine Preisch
(74) *Attorney, Agent, or Firm*—J. Farrant

(57) ABSTRACT

Processes and apparatus for providing improved contaminant removal and hydrogen reuse in reactors, particularly in refineries and petrochemical plants. The improved contaminant removal is achieved by selective purging, by passing gases in the reactor recycle loop across membranes selective in favor of the contaminant over hydrogen.

37 Claims, 7 Drawing Sheets

SELECTIVE PURGE FOR REACTOR RECYCLE LOOP

FIELD OF THE INVENTION

The invention relates to improved contaminant removal and hydrogen reuse in hydrocarbon conversion reactors, by passing gases in the reactor recycle loop across selective membranes.

BACKGROUND OF THE INVENTION

Many operations carried out in refineries and petrochemical plants involve feeding a hydrocarbon/hydrogen stream to a reactor, withdrawing a reactor effluent stream of different hydrocarbon/hydrogen composition, separating the effluent into liquid and vapor portions, and recirculating part of the vapor stream to the reactor, so as to reuse unreacted hydrogen. Such loop operations are found, for example, in the hydrotreater, hydrocracker, and catalytic reformer sections of most modern refineries, as well as in isomerization reactors and hydrodealkylation units.

The phase separation into liquid and vapor portions is often carried out in one or more steps by simply changing the pressure and/or temperature of the effluent. Therefore, in addition to hydrogen, the overhead vapor from the phase separation usually contains light hydrocarbons, particularly methane and ethane. In a closed recycle loop, these components build up, change the reactor equilibrium conditions and can lead to reduced product yield. This build-up of undesirable contaminants is usually controlled by purging a part of the vapor stream from the loop. Such a purge operation is unselective however, and, since the purge stream may contain as much as 80 vol % or more hydrogen, multiple volumes of hydrogen can be lost from the loop for every volume of contaminant that is purged. The purge stream may be treated by further separation in some downstream operation, or may simply pass to the plant fuel header.

The impetus for hydrogen recovery in the reactor loop is two-fold. First, demand for hydrogen in refineries and petrochemical plants is high, and it is almost always more cost-effective to try to reuse as much gas as is practically possible than to meet the hydrogen demand entirely from fresh stocks. Secondly, it is desirable in most operations to maintain a high hydrogen partial pressure in the reactor. The availability of ample hydrogen during the reaction step prolongs the life of the catalyst by controlling coke formation, and suppresses the formation of non-preferred, low value products.

Hydrogen recovery techniques that have been deployed in refineries include, besides simple phase separation of fluids, pressure swing adsorption (PSA) and membrane separation. U.S. Pat. No. 4,362,613, to Monsanto, describes a process for treating the vapor phase from a high-pressure separator in a hydrocracking plant by passing the vapor across a membrane that is selectively permeable to hydrogen. The process yields a hydrogen-enriched permeate that can be recompressed and recirculated to the hydrocracker reactor. U.S. Pat. No. 4,367,135, also to Monsanto, describes a process in which effluent from a low-pressure separator is treated to recover hydrogen using the same type of hydrogen-selective membrane. U.S. Pat. No. 4,548,619, to UOP, shows membrane treatment of the overhead gas from an absorber treating effluent from benzene production. The membrane again permeates the hydrogen selectively and produces a hydrogen-enriched gas product that is withdrawn from the process. U.S. Pat. No. 5,053,067, to L'Air Liquide, discloses removal of part of the hydrogen from a refinery off-gas to change the dewpoint of the gas to facilitate downstream treatment. U.S. Pat. No. 5,082,481, to Lummus Crest, describes removal of carbon dioxide, hydrogen and water vapor from cracking effluent, the hydrogen separation being accomplished by a hydrogen-selective membrane. U.S. Pat. No. 5,157,200, to Institut Francais du Petrole, shows treatment of light ends containing hydrogen and light hydrocarbons, including using a hydrogen-selective membrane to separate hydrogen from other components. U.S. Pat. No. 5,689,032, to Krause/Pasadyn, discusses a method for separating hydrogen and hydrocarbons from refinery off-gases, including multiple low-temperature condensation steps and a membrane separation step for hydrogen removal.

The use of certain polymeric membranes to treat off-gas streams in refineries is also described in the following papers: "Hydrogen Purification with Cellulose Acetate Membranes", by H. Yamashiro et al., presented at the Europe-Japan Congress on Membranes and Membrane Processes, June 1984; "Prism™ Separators Optimize Hydrocracker Hydrogen", by W. A. Bollinger et al., presented at the AIChE 1983 Summer National Meeting, August 1983; "Plant Uses Membrane Separation", by H. Yamashiro et al., in Hydrocarbon Processing, February 1985; and "Optimizing Hydrocracker Hydrogen", by W. A. Bollinger et al., in Chemical Engineering Progress, May 1984. These papers describe system designs using cellulose acetate or similar membranes that permeate hydrogen and reject hydrocarbons. The use of membranes in refinery separations is also mentioned in "Hydrogen Technologies to Meet Refiners' Future Needs", by J. M. Abrardo et al. in Hydrocarbon Processing, February 1995. This paper points out the disadvantage of membranes, namely that they permeate the hydrogen, thereby delivering it at low pressure, and that they are susceptible to damage by hydrogen sulfide and heavy hydrocarbons.

A chapter in "Polymeric Gas Separation Membranes", D. R. Paul et al. (Eds.) entitled "Commercial and Practical Aspects of Gas Separation Membranes", by Jay Henis describes various hydrogen separations that can be performed with hydrogen-selective membranes.

Literature from Membrane Associates Ltd., of Reading, England, shows and describes a design for pooling and downstream treating various refinery off-gases, including passing of the membrane permeate stream to subsequent treatment for LPG recovery.

Other references that describe membrane-based separation of hydrogen from gas streams in a general way include U.S. Pat Nos. 4,654,063 and 4,836,833, to Air Products, and U.S. Pat. No. 4,892,564, to Cooley.

U.S. Pat. No. 5,332,424, to Air Products, describes fractionation of a gas stream containing light hydrocarbons and hydrogen using an "adsorbent membrane". The membrane is made of carbon, and selectively adsorbs hydrocarbons onto the carbon surface, allowing separation between various hydrocarbon fractions to be made. Hydrogen tends to be retained in the membrane residue stream. Other Air Products patents that show application of carbon adsorbent membranes to hydrogen/ hydrocarbon separations include U.S. Pat. Nos. 5,354,547; 5,435,836; 5,447,559 and U.S. Pat. No. 5,507,856, which all relate to purification of streams from steam reformers. U.S. Pat. No. 5,634,354, to Air Products, discloses removal of hydrogen from hydrogen/olefin streams. In this case, the membrane used to perform the separation is either a polymeric membrane selective for hydrogen over hydrocarbons or a carbon adsorbent membrane selective for hydrocarbons over hydrogen.

U.S. Pat. No. 4,857,078, to Watler, mentions that, in natural gas liquids recovery, streams that are enriched in hydrogen can be produced as retentate by a rubbery membrane.

SUMMARY OF THE INVENTION

The invention is a process for facilitating purging of a reactor loop in a refinery, petrochemical plant or the like. The process can be applied to any loop in which hydrogen is fed to a reactor, such as a hydrocracker or a catalytic reformer, and in which hydrogen and one or more hydrocarbons are present in the effluent from the reactor. In its most basic aspect, the process of the invention comprises the following steps:

a) withdrawing an effluent stream comprising hydrogen and hydrocarbons from a reactor;

(b) separating a vapor phase comprising hydrogen and a light hydrocarbon from the effluent stream;

(c) passing at least a portion of the vapor phase across the feed side of a polymeric membrane having a feed side and permeate side, and being selective for the light hydrocarbon over hydrogen;

(d) withdrawing from the permeate side a purge stream enriched in the light hydrocarbon compared with the vapor phase;

(e) withdrawing from the feed side a residue stream enriched in hydrogen compared with the vapor phase;

(f) recirculating at least a portion of the residue stream to the reactor.

In another aspect, the invention is reactor apparatus comprising a reactor loop incorporating the reactor itself, the phase separation equipment and the membrane separation unit containing a contaminant-selective membrane.

The invention has an important advantage over other polymeric membrane separation processes that have been used in the industry in the past: the membranes are hydrogen-rejecting. That is, all hydrocarbons, including methane, permeate the membrane preferentially, leaving a residue stream on the feed side that is concentrated in the slower-permeating hydrogen.

This means that the membrane provides a selective purge capability. The contaminant purge stream, that is, the permeate stream from the membrane, is substantially depleted in hydrogen. Thus, the proportionate loss of hydrogen per volume of contaminant purged can be reduced several fold compared with the conventional loop process. The purged contaminant may be a hydrocarbon or any other contaminant, such as hydrogen sulfide, that can be removed by preferential permeation compared to hydrogen.

Furthermore, since the hydrogen content of the purge stream is reduced, the hydrogen content of the recirculated stream is correspondingly increased. Therefore, under some circumstances, the process can provide, per volume of gas purged, a slightly higher hydrogen partial pressure in the reactor than was achieved previously. As mentioned above, this is beneficial in increasing catalyst life and suppressing low-value products.

A further particular benefit of our invention is that the recycle stream is retained on the high-pressure side of the membrane. The ability to deliver this recycle gas without the need for recompression from the comparatively low pressure on the permeate side of the membrane is attractive.

Another important advantage is that polymeric materials are used for the membranes. This renders the membranes easy and inexpensive to prepare, and to house in modules, by conventional industrial techniques, unlike other types of hydrogen-rejecting membranes, such as finely microporous inorganic membranes, including adsorbent carbon membranes, pyrolysed carbon membranes and ceramic membranes, which are difficult and costly to fabricate in industrially useful quantities.

The preferred membranes used in the present invention permeate all of the hydrocarbons, hydrogen sulfide and water vapor preferentially over hydrogen, and are capable of withstanding exposure to these materials even in comparatively high concentrations. This contrasts with cellulose acetate and like membranes, which must be protected from exposure to heavy hydrocarbons and water. If liquid water or $C_{3+}$ hydrocarbons condense on the surface of such membranes, which can happen if the temperature within the membrane modules is lower than the upstream temperature and/or as the removal of hydrogen through the membrane increases the concentration of other components on the feed side, the membranes can suffer catastrophic failure. On the other hand, the membranes used in the invention preferentially and rapidly pass these components, so they do not build up on the feed side. Thus, the membranes can handle a diversity of stream types including, for example, gases produced when feedstocks heavily laden with sulfur are hydroprocessed. This is a differentiating and important advantage over processes that have previously been available.

The membrane separation step may be carried out on the entirety of the stream to be recirculated to the reactor, or may be performed on part of the stream, with another part of the stream being recirculated directly to the reactor. The membrane step may take the form of a single step or of multiple sub-steps, depending on the feed composition, membrane properties and desired results.

The phase separation step may be carried out in any convenient manner, as a single-stage operation, or in multiple sub-steps. The effluent from hydrocracking reactors and the like is typically at high temperature, so, for example, the phase separation step may involve cooling to liquefy the heavier components of the stream. Alternatively, or in addition, the pressure on a liquid may be lowered to flash off the most volatile materials.

Additional separation steps may be carried out in the loop as desired to supplement the phase separation or membrane separation steps or to remove secondary components from the stream.

Specific exemplary separations to which the process of the invention can be applied include, but are not limited to, separation of light hydrocarbons from hydrogen in off-gas streams from: hydrocrackers; hydrotreaters of various kinds, including hydrodesulfurization units; coking reactors; catalytic reformers; specific isomerization, alkylation and dealkylation units; steam reformers; hydrogenation and dehydrogenation processes; and steam crackers for olefin production.

It is to be understood that the above summary and the following detailed description are intended to explain and illustrate the invention without restricting its scope.

DETAILED DESCRIPTION OF THE INVENTION

Figure 1:
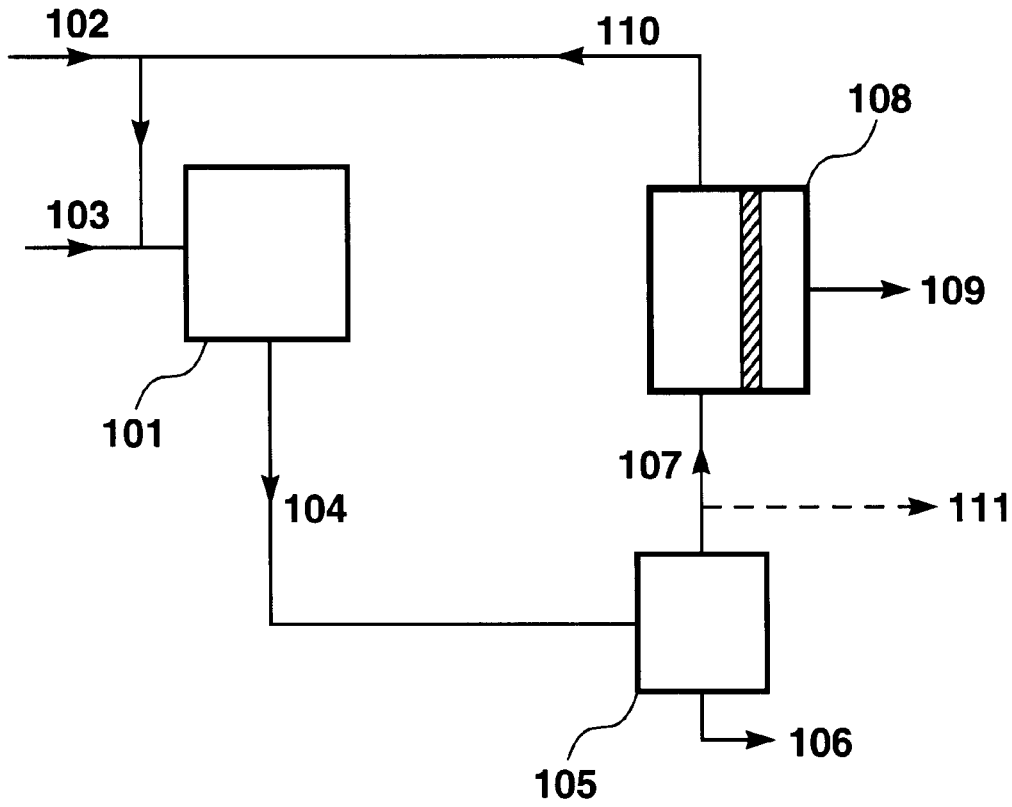
FIG. 1 is a schematic drawing showing a basic embodiment of the invention.

The terms gas and vapor are used interchangeably herein.

The term $C_{2+}$ hydrocarbon means a hydrocarbon having at least two carbon atoms; the term $C_{3+}$ hydrocarbon means a hydrocarbon having at least three carbon atoms; and so on.

The term $C_{2-}$ hydrocarbon means a hydrocarbon having no more than two carbon atoms; the term $C_{3-}$ hydrocarbon means a hydrocarbon having no more than three carbon atoms; and so on.

The term light hydrocarbon means a hydrocarbon molecule having no more than about six carbon atoms.

The term lighter hydrocarbons means $C_1$ or $C_2$ hydrocarbons.

The term heavier hydrocarbons means $C_{3+}$ hydrocarbons.

Percentages herein are by volume unless otherwise stated.

The invention is a process for facilitating purging of a reactor loop in a refinery, petrochemical plant or the like. By a reactor loop, we mean a configuration in which at least a part of the effluent stream from a reactor is recirculated to the reactor. The process can be applied to any loop in which hydrogen is fed to the reactor, and in which hydrogen and one or more hydrocarbons are present in the effluent. The primary goal of the process is to provide selective purging of contaminant gases from the reactor loop, thereby diminishing hydrogen loss from the process. A second goal is to increase recovery of the heavier hydrocarbons from the gases purged from the loop.

In its most basic aspect, the invention is a process that involves separating the effluent from the reactor into liquid and vapor portions, purging at least some of the vapor portion selectively by using a hydrogen-rejecting membrane separation unit, and returning the contaminant-depleted stream to the reactor. In another aspect, the invention is an improved apparatus train for carrying out a hydrocarbon conversion reaction.

Although it could be used in any field where reactor effluent streams are laden with hydrocarbons and hydrogen, the invention is expected to be of particular use in the fields of oil refining and petrochemical production. Those of skill in the art will appreciate that numerous opportunities exist for its employment in those areas, and that the brief discussion of a few applications that follows is intended to be exemplary rather than limiting.

As a first example, the major consumers of hydrogen in a refinery are the hydroprocessing units. Hydroprocessing covers various refinery operations, including, but not limited to, catalytic hydrodesulfurization (CHD), hydrotreating to remove other contaminants, pretreatment of reformer feedstocks, and hydrocracking to break down polycyclic aromatic compounds. Modern refineries often carry out these operations together, such as in multi-stage reactors, where the first stage predominantly converts sulfur compounds and the second stage predominantly performs the cracking step. In hydroprocessing, fresh feed is mixed with hydrogen and recycle gas and fed to the reactor, where the desired reactions take place in the presence of a suitable catalyst. For example, hydrogen is consumed to form hydrogen sulfide from mercaptans and the like, to form paraffins from olefins, and to open and saturate aromatic rings. As a result, light components formed include methane, ethane and hydrogen sulfide. The reactor effluent enters a separator, usually at high pressure, from which a hydrogen-rich vapor fraction is withdrawn and returned to the reactor. The hydrogen demand varies, depending on the specifics of the operation being performed, and may be as low as 200 scf/bbl or less for desulfurization of naphtha or virgin light distillates, 500–1,000 scf/bbl for treating atmospheric resid, upwards of 1,000 scf/bbl for treatment of vacuum resid, and as high as 5,000–10,000 scf/bbl for hydrocracking.

Not all of this hydrogen is consumed in the reactions. Reactors are generally run with an excess of hydrogen in the feed to protect the catalyst from coke formation, thereby prolonging the cycle time of the reactor. Generous use of hydrogen also promotes high levels of sulfur removal and depresses the formation of unsaturated compounds, which tend to be of lower value in this context.

As a function of these requirements, the light gas fraction recirculated from the separators to the reactors is rich in hydrogen, and may consist of as much as 80 vol % or more hydrogen. Other components are typically $C_1$–$C_3$ hydrocarbons, hydrogen sulfide, heavier hydrocarbons, carbon dioxide, nitrogen, ammonia and other trace materials. If certain of these components, such as the light hydrocarbons and hydrogen sulfide, are allowed to build up in the reactor loop, they gradually change the composition of the reactor mix and adversely affect the product yield and the catalyst. The invention can be used to purge light hydrocarbons, hydrogen sulfide and most other components from the loop with very little loss of hydrogen.

Another important exemplary application of the invention is in catalytic reforming, the primary goal of which is to improve the octane quality of gasoline feedstocks. The reformer is a net hydrogen producer, and in most refineries hydrogen thus generated is used in other units, such as the hydrotreaters. In the reformer, the n-paraffin components of virgin or cracked naphthas are converted to higher octane iso-paraffins and aromatics. The process is generally carried out in three reaction zones, in each of which specific reactions are favored. For example, the first zone may perform, among other reactions, dehydrogenation of methylcyclohexane to toluene, the second zone may perform dehydroisomerization, such as conversion of heptane to toluene, and the third zone may perform isomerization of normal to iso-heptane. Although the process is an overall producer of hydrogen, hydrogen is recycled back to the feed to maintain the hydrogen-to-hydrocarbon ratio in the reactors within a range to favor the desired reactions and to prolong the catalyst life.

The gaseous effluent from the reactor series is cooled and separated into liquid and vapor phases. The vapor phase may be subjected to other hydrogen purification steps, and is divided into two streams, one for return to the reformer, the other for use elsewhere in the refinery. The invention can be used as part of the vapor phase treatment, to remove other components from the loop while reducing hydrogen losses.

A third exemplary application is in isomerization, a broad term that covers a variety of specific operations. In the refinery, isomerization is used to improve the quality of light straight-run gasoline by converting normal $C_5$ and $C_6$ paraffins to iso-paraffins. Another important use is conversion of n-butane to iso-butane for alkylate manufacture. Isomerization is used in the petrochemical industry to convert isomers of butene, pentene, hexene and other olefins to preferred forms as feedstocks for other processes, such as MTBE and TAME manufacture. Another important petrochemical application of isomerization is the conversion of other $C_8$ compounds into paraxylene, the starting feedstock for polyester manufacture. Although isomerization reactions themselves do not consume hydrogen, hydrogen is used in the isomerization reactor gas mix to protect the catalyst from coking, and small amounts of hydrogen are consumed by secondary reactions that take place. The layout of the process is often, therefore, similar to those already described; the effluent from the reactors is cooled and separated into liquid and vapor phases, and, after purging as necessary, the vapor phase is recirculated to the reactors. The invention can be used as described above to treat the vapor phase from the separators to provide selective removal of hydrocarbons with little hydrogen loss.

A fourth opportunity for our process is in hydrodealkylation, principally benzene production from toluene. The toluene/benzene conversion is usually performed by cracking at high temperature, such as above 600° C., in the presence of hydrogen. Typically a molar ratio of hydrogen to hydrocarbon of about 4 is used, and the process consumes as much as 1,500 scf of hydrogen per barrel of hydrocarbon processed. In the typical process, toluene, make-up hydrogen and recycle hydrogen are heated and enter the reactor, where toluene and hydrogen react to form benzene and methane. The effluent is withdrawn from the reactor and passed through separators that both cool and reduce the pressure of the effluent. The hydrocarbon liquid mixture that results is stabilized, then the benzene product is separated from the heavier aromatics, at least part of which are recycled to the reactor for further conversion. The vapor phase from the separators is subjected to additional hydrogen purification if necessary and the remaining hydrogen is returned for reuse in the reactor. As can be seen, the opportunity again exists to apply our process in the vapor recirculation loop. Thus the loop can include, in any order as convenient, cooling steps to remove liquid, flashing to remove light components from liquid, membrane separation to selectively purge hydrocarbons from hydrogen, and other hydrogen purification treatments, such as further membrane treatment by hydrogen-selective, rather than hydrogen-rejecting membranes, pressure swing adsorption, and so on.

The invention in a basic aspect is shown schematically in FIG. 1. Referring to this figure, box 101 represents the reactor. The reactor may be of any type and may perform any hydrocarbon conversion reaction, within the limits of the invention; that is, the reactor feed contains at least hydrogen and a hydrocarbon, and the reactor effluent also contains hydrogen and a hydrocarbon, but in a different composition. FIG. 1 shows three feed streams: 103, the hydrocarbon feedstock stream; 102, the fresh hydrogen stream; and 110, the recycle stream, entering the reactor. Very commonly, the streams will be combined as shown and passed through compressors, heat exchangers or direct-fired heaters (not shown) to bring them to the appropriate reaction conditions before entering the reactors. Alternatively, the streams can be prepared and fed separately to the reactor. Commonly, the hydrocarbon stream, 103, itself may be a combination of recycled unreacted hydrocarbons and fresh feed.

As mentioned above with respect to the specific applications, one or multiple reactors may be involved in the process, with the individual reactors carrying out the same or different unit operations. The reactor operating conditions are not critical to the invention and can and will vary over a wide range, depending on the function of the reactor. For example, hydrocracking reactions generally require high pressure and temperature, and hydrocrackers run at pressures as high as 1,500–3,000 psig and temperatures as high as 250–400° C. Hydrodealkylation is performed at more modest pressures, but at very high temperatures, such as 600–700° C. Isomerization conditions can be milder, such as 250–400 psig and 250–350° C. Thus, the invention embraces all reactor temperature and pressure conditions.

The effluent stream, 104, is withdrawn from the reactor. Depending upon the conditions in the reactor and/or the exit conditions, this stream may be gaseous, liquid or a mixture of both. The first treatment step required is to separate the stream into discrete liquid and gas phases, shown as streams 106 (liquid) and 107 (vapor) in FIG. 1. This separation step is indicated simply as box 105, although it will be appreciated that it can be executed in one or multiple sub-steps. For example, the effluent from a hydrocracker may be at 350° C. and may be reduced in temperature in three stages to 50° C. In this case, the vapor phase from the first sub-step forms the feed to the second sub-step, and so on. The cooling step or steps may be performed by heat exchange against other plant streams, and/or by using air cooling, water cooling or refrigerants, depending on availability and the desired final temperature. Such techniques are familiar to those of skill in the art. The physical nature of the separator vessel can be chosen from simple gravity separators, cyclone separators or any other convenient type.

If the effluent is in the liquid phase, either directly as it emerges from the reactor or after one or more cooling steps, a fraction consisting of hydrogen and other light gases can be flashed off. Typically, flashing is achieved by letting down the pressure on the liquid, thereby achieving essentially instantaneous conversion of a portion of the liquid to the gas phase. This may be done by passing the liquid through an expansion valve into a receiving tank or chamber, or any other type of phase separation vessel, for example. The released gas can be drawn off from the upper part of the chamber; the remaining liquid can be withdrawn from the bottom. Flashing may be carried out in a single stage, or in multiple stages at progressively lower pressures. If multiple flash stages are used, each will generate its own vapor overhead stream.

From the above description, it is clear that the liquid phase from the separation step may be in the form of one or multiple streams. The liquid stream or streams, indicated generally as 106 in FIG. 1, pass to downstream destinations and/or treatment as desired.

The vapor phase may also be in the form of one or multiple streams, and any one of these, or combinations of these, may be recirculated to the reactor within the scope of the invention. For example, in prior art reactors operating at elevated temperatures and pressures, the phase separation step is commonly carried out first by maintaining the effluent at a relatively high pressure, but cooling it, yielding a comparatively hydrogen-rich vapor phase. The liquid from this step is then let down to a lower pressure, thereby flashing off a light gas fraction. This light gas fraction, which tends to be leaner in hydrogen and richer in light hydrocarbons than the vapor from the high pressure separation step, is usually not recirculated to the reactor, but is sent to the fuel gas line.

The process of the invention may be carried out according to this scheme, so that only the most hydrogen-rich of the vapor fractions forms stream 107. Alternatively, stream 107 may comprise vapor from a lower pressure separation step, or both the higher and lower pressure streams may be treated and recirculated with the loop.

Stream 107 passes as feed to the membrane purge step, shown as 108 in FIG. 1. The membrane unit contains a membrane that exhibits a substantially different permeability for hydrocarbons than for hydrogen.

The permeability of a gas or vapor through a membrane is a product of the diffusion coefficient, D, and the Henry's law sorption coefficient, k. D is a measure of the permeant's mobility in the polymer; k is a measure of the permeant's sorption into the polymer. The diffusion coefficient tends to decrease as the molecular size of the permeant increases, because large molecules interact with more segments of the polymer chains and are thus less mobile. The sorption coefficient depends, amongst other factors, on the condensability of the gas.

Depending on the nature of the polymer, either the diffusion or the sorption component of the permeability may dominate. In rigid, glassy polymer materials, the diffusion coefficient tends to be the controlling factor and the ability of molecules to permeate is very size dependent. As a result, glassy membranes tend to permeate small, low-boiling molecules, such as hydrogen and methane, faster than larger, more condensable molecules, such as $C_{2+}$ organic molecules. For rubbery or elastomeric polymers, the difference in size is much less critical, because the polymer chains can be flexed, and sorption effects generally dominate the permeability. Elastomeric materials, therefore, tend to permeate large, condensable molecules faster than small, low-boiling molecules. Thus, most rubbery materials are selective in favor of all $C_{3+}$ hydrocarbons over hydrogen. However, for the smallest, least condensable hydrocarbons, methane in particular, even rubbery polymers tend to be selective in favor of hydrogen, because of the relative ease with which the hydrogen molecule can diffuse through most materials. For example, neoprene rubber has a selectivity for hydrogen over methane of about 4, natural rubber a selectivity for hydrogen over methane of about 1.6, and Kraton, a commercial polystyrene-butadiene copolymer, has a selectivity for hydrogen over methane of about 2.

Any rubbery material that is selective for $C_{2+}$ hydrocarbons over hydrogen will provide selective purging of these components and can be used in the invention. Examples of polymers that can be used to make such elastomeric membranes, include, but are not limited to, nitrile rubber, neoprene, polydimethylsiloxane (silicone rubber), chlorosulfonated polyethylene, polysilicone-carbonate copolymers, fluoroelastomers, plasticized polyvinylchloride, polyurethane, cis-polybutadiene, cis-polyisoprene, poly(butene-1), polystyrene-butadiene copolymers, styrene/butadiene/styrene block copolymers, styrene/ethylene/butylene block copolymers, and thermoplastic polyolefin elastomers.

The preferred membrane differs from other membranes used in the past in refinery and petrochemical processing applications in that it is more permeable to all hydrocarbons, including methane, than it is to hydrogen. In other words, unlike almost all other membranes, rubbery or glassy, the membrane is methane/hydrogen selective, that is, hydrogen rejecting, so that the permeate stream is hydrogen depleted and the residue stream is hydrogen enriched, compared with the membrane feed stream. To applicants' knowledge, among the polymeric membranes that perform gas separation based on the solution/diffusion mechanism, silicone rubber is the only material that is selective in favor of methane over hydrogen. As will now be appreciated by those of skill in the art, at least some of the benefits that accrue from the invention derive from the use of a membrane that is both polymeric and hydrogen rejecting. Thus, any polymeric membrane that is found to have a methane/hydrogen selectivity greater than 1 can be used for the processes disclosed herein and is within the scope of the invention. For example, other materials that might perhaps be found by appropriate experimentation to be methane/hydrogen selective include other polysiloxanes.

Another class of polymer materials that has at least a few members that should be methane/hydrogen selective, at least in multicomponent mixtures including other more condensable hydrocarbons, is the superglassy polymers, such as poly(1-trimethylsilyl-1-propyne) [PTMSP] and poly(4-methyl-2-pentyne) [PMP]. These differ from other polymeric membranes in that they do not separate component gases by solution/diffusion through the polymer. Rather, gas transport is believed to occur based on preferential sorption and diffusion on the surfaces of interconnected, comparatively long-lasting free-volume elements. Membranes and modules made from these polymers are less well developed to date; this class of materials is, therefore, less preferred than silicone rubber.

A third type of membrane that may be used if the contaminant of primary concern is hydrogen sulfide is one in which the selective layer is a polyamide-polyether block copolymers having the general formula

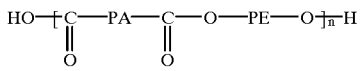

where PA is a polyamide segment, PE is a polyether segment and n is a positive integer. Such polymers are available commercially as Pebax® from Atochem Inc., Glen Rock, N.J. or as Vestamid® from Nuodex Inc., Piscataway, N.J.. These types of materials are described in detail in U.S. Pat. No. 4,963,165, for example. Such membranes will remove hydrogen sulfide with a very high selectivity, such as 20 or more, for hydrogen sulfide over hydrogen. They are, however, selective in favor of hydrogen over methane, with a selectivity of about 1 to 2, depending on grade, so are not preferred where methane build up in the loop is the greatest concern.

The membrane separation step is used to purge contaminants from the recycle loop; this purged contaminant portion is removed as permeate stream 109. The membranes permeate all hydrocarbons, hydrogen sulfide, carbon monoxide, carbon dioxide, water vapor and ammonia faster than hydrogen. Thus, permeate stream 109 is substantially enriched in hydrocarbons, and the other components mentioned above, if they are present, and depleted in hydrogen, compared with feed stream 107. Those of skill in the art will appreciate that the membrane area and membrane separation step operating conditions can be varied depending on whether the component of most interest to be enriched in the permeate is methane, ethane, a $C_{3+}$ hydrocarbon, hydrogen sulfide or some other material. For example, the concentration of propane might be raised from 2 vol % in the feed to 10 vol % in the permeate, or the hydrogen sulfide concentration might be raised from 5% to 20%. Correspondingly, the hydrogen content might be diminished from 75 vol % in the feed to 50 vol % in the permeate.

This capability can be used to advantage in several ways. In one aspect, the mass of a specific contaminant purged from the reactor recycle loop can be controlled. Suppose reactor conditions and flow rates are such that it is necessary, by whatever means, to remove 2,500 lb/h of total hydrocarbons from the reactor loop. Without the membrane separation step, this level of removal might result in the purging and loss of 600 lb/h of hydrogen. By purging the permeate stream, a flow of 2,500 lb/h of hydrocarbons can be removed by purging only 350 lb/h of hydrogen. This has two immediate benefits. On the one hand, the purge stream is much more concentrated in hydrocarbons than would have been the case if an unselective purge had been carried out. This facilitates further separation and recovery of the hydrocarbons downstream. On the other hand, the hydrogen loss with the purge is reduced, in favorable cases to half or less of what it would be if unselective purging were practiced.

In another aspect, the process can provide a lower level of contaminants in the reactor. Suppose it is desired to operate the reactor at the lowest practical hydrogen sulfide content in the reactor gas mix, while maintaining hydrogen recovery from the vapor stream at 50%. Absent the membrane separation step, this would be accomplished by dividing stream 107 in half, directing one half to the purge, the other back to the reactor. Suppose this had the effect of returning 400 lb/h of hydrogen sulfide to the reactor and purging 400 lb/h of hydrogen sulfide. By passing the purge stream through the membrane separation unit, however, a permeate purge stream is created that has less hydrogen per unit of hydrogen sulfide than was present in the feed. In this case, loss of 50% hydrogen into the permeate purge is accompanied by a higher loss of hydrogen sulfide, say 600 lb/h in the permeate stream. Thus, the hydrogen recovery can be maintained at the desired level, but results in a lesser amount of hydrogen sulfide per pass (only 200 lb/h) being returned to the reactor mix. This provides a mechanism for improving the reactor conditions, and may enable the feed throughput of the reactor to be increased, and/or the cycle time to be extended.

In yet another aspect, by selectively removing the non-hydrogen components, the process results in a membrane residue stream, 110, that is enriched in hydrogen content compared with stream 107. Of course, if desired, the membrane separation unit can be configured and operated to provide a residue stream that has a significantly higher hydrogen concentration compared with the feed, such as 90 vol %, 95 vol % or more, subject only to the presence of any other slow-permeating component, such as nitrogen, in the feed. This can be accomplished by increasing the stage-cut of the membrane separation step, that is, the ratio of permeate flow to feed flow, to the point that little of anything except hydrogen is left in the residue stream. As the stage-cut is raised, however, the purge becomes progressively less selective. This can be clearly seen by considering that, in the limit, if the stage-cut were allowed to go to 100%, all of the gas present in the feed would pass to the permeate side of the membrane and the purge would become completely unselective. Since the purpose of the invention is to control or diminish loss of hydrogen by selective purging, a very high stage-cut, and hence a high hydrogen concentration in the residue, defeats the purpose of the invention. It is preferred, therefore, to keep the stage-cut low, such as below 50%, more preferably below 40% and most preferably below 30%. Those of skill in the art will appreciate that within these guidelines, the stage-cut can be chosen to meet the desired purging objectives, in terms of hydrogen loss and contaminant removal. Typically, it is possible, as illustrated in the examples section below, to reduce the hydrogen concentration of the permeate, compared with the hydrogen concentration in the feed, by at least about 1.5 times, 2 times, and sometimes by as much as 5 times, 10 times or much more. Based on the above considerations, the residue stream, 110, will be enriched in hydrogen compared with the feed. However, the hydrogen concentration will be only slightly higher than the feed, such as no more than about 1%, 2% or 5% higher. This in turn will lead to a slightly higher hydrogen partial pressure in the reactor. Even though this partial pressure increase is comparatively small, it may be beneficial in improving desired product yield and prolonging catalyst life.

An advantage of using a hydrogen-rejecting membrane is that the stream that is recirculated in the reactor loop remains on the high-pressure side of the membrane. This reduces recompression requirements, compared with the situation that would obtain if a hydrogen-selective membrane were to be used. In that case, the permeate stream might be at only 10% or 20% the pressure of the feed, and would need substantial recompression before it could be returned to the reactor.

A benefit of using silicone rubber or superglassy membranes is that they provide much higher transmembrane fluxes than conventional glassy membranes. For example, the permeability of silicone rubber to methane is 800 Barrer, compared with a permeability of only less than 10 Barrer for 6FDA polyimide or cellulose acetate.

The membrane may take any convenient form known in the art. The preferred form is a composite membrane including a microporous support layer for mechanical strength and a silicone rubber coating layer that is responsible for the separation properties. Additional layers may be included in the structure as desired, such as to provide strength, protect the selective layer from abrasion, and so on.

The membranes may be manufactured as flat sheets or as fibers and housed in any convenient module form, including spiral-wound modules, plate-and-frame modules and potted hollow-fiber modules. The making of all these types of membranes and modules is well known in the art. Flat-sheet membranes in spiral-wound modules are our most preferred choice. Since conventional polymeric materials are used for the membranes, they are relatively easy and inexpensive to prepare and to house in modules, compared with other types of membranes that might be used as hydrogen-rejecting membranes, such as finely microporous inorganic membranes, including adsorbent carbon membranes, pyrolysed carbon membranes and ceramic membranes.

To achieve a high flux of the preferentially permeating hydrocarbons, the selective layer responsible for the separation properties should be thin, preferably, but not necessarily, no more than 30 $\mu$m thick, more preferably no more than 20 $\mu$m thick, and most preferably no more than 5 $\mu$m thick. If superglassy materials are used, their permeabilities are so high that thicker membranes are possible.

A driving force for transmembrane permeation is provided by a pressure difference between the feed and permeate sides of the membrane. As mentioned above, at least some of the reactions within the scope of the invention will involve high pressure conditions in the reactor, and at least some of the phase separation steps will maintain the vapor at a high pressure, such as 200 psig, 500 psig or above. Feed pressures at this level will be adequate in many instances to provide acceptable membrane performance. In favorable cases such as this, the membrane separation unit requires no additional compressors or other pieces of rotating equipment than would be required for a prior art process without selective purging. The recycle stream remains at or close to the pressure of the separator overhead, subject only to a slight pressure drop along the feed surface of the membrane modules, and can, therefore, be sent to a recycle compressor of essentially the same capacity as would have been required in the prior art system. If the pressure of stream 107 is insufficient to provide adequate driving force, a compressor may be included in line 107 between the phase separation step and the membrane separation step to boost the feed gas pressure.

Depending on the composition of the membrane feed stream 107, a single-stage membrane separation operation may be adequate to produce a permeate stream with an acceptably high contaminant content and low hydrogen content. If the permeate stream requires further separation, it may be passed to a second bank of modules for a second-stage treatment. If the second permeate stream requires further purification, it may be passed to a third bank of modules for a third processing step, and so on. Likewise, if the residue stream requires further contaminant removal, it may be passed to a second bank of modules for a second-step treatment, and so on. Such multistage or multistep processes, and variants thereof, will be familiar to those of skill in the art, who will appreciate that the membrane separation step may be configured in many possible ways, including single-stage, multistage, multistep, or more complicated arrays of two or more units in series or cascade arrangements. Representative embodiments of a few of such arrangements are given in the examples below.

FIG. 1 shows membrane permeate purge stream 109 as vapor exiting the reactor loop. It will be appreciated by those of skill in the art that the selective purge provided by the membrane separation step may be augmented by conventional purging of a portion of stream 107 directly from the loop if desired, as indicated by dashed arrow 111. This reduces the amount of gas that has to be processed by the membrane separation unit and can be attractive economically for some applications.

Stream 110 is withdrawn from the membrane separation step and is recirculated to the reactor inlet. Following the phase separation and membrane separation steps, some small amount of recompression is usually needed to bring stream 110 back to reactor pressure, and this can be accomplished by directing stream 110 through a compressor, not shown in FIG. 1. Alternatively, if a compressor is in use to raise the pressure of streams 102 and/or 103, stream 110 may be directed to the inlet side of this compressor. Such variants will be easily determined based on the present teachings, and are within the scope of the invention.

FIG. 1 shows the entirety of stream 110 being returned in the reactor loop. Alternatively a portion of the stream is drawn off for use elsewhere. For example, in catalytic reformers and other hydrogen-producing reactors, a substantial portion of the hydrogen-rich vapor may be withdrawn for additional treatment, if necessary, followed by use in the hydrogen-consuming reactors, such as hydrotreaters and hydrocrackers.

FIG. 1 can also be used to show the basic elements of the apparatus of the invention in its simplest embodiment. In this respect, lines 103, 102 and 110, carrying the hydrocarbon feedstock, the fresh hydrogen supply and the recycle hydrogen, respectively form the feed stream inlet line to reactor, 101. The reactor is capable of carrying out the type of hydrocarbon conversions described, and has an effluent outlet line, 104, through which fluid can pass, either directly as shown or via some intermediate treatment, to the phase separator or separators, 105. The phase separator has a liquid outlet line, 106, and a vapor outlet line, 107. The vapor outlet line is connected, either directly as shown, or via intermediate equipment as appropriate, to the feed side of membrane separation unit, 108. This unit contains membranes that are selective in favor of a light hydrocarbon over hydrogen, so as to produce a hydrocarbon-enriched permeate stream and a hydrocarbon-depleted, hydrogen-enriched residue stream. The membrane unit has a permeate outlet 109 and a residue, feed-side outlet, 110, which is connected so that the hydrogen-enriched residue gas can be passed back into the reactor. Dashed line 111 is an optional purge outlet line.

Figure 2:
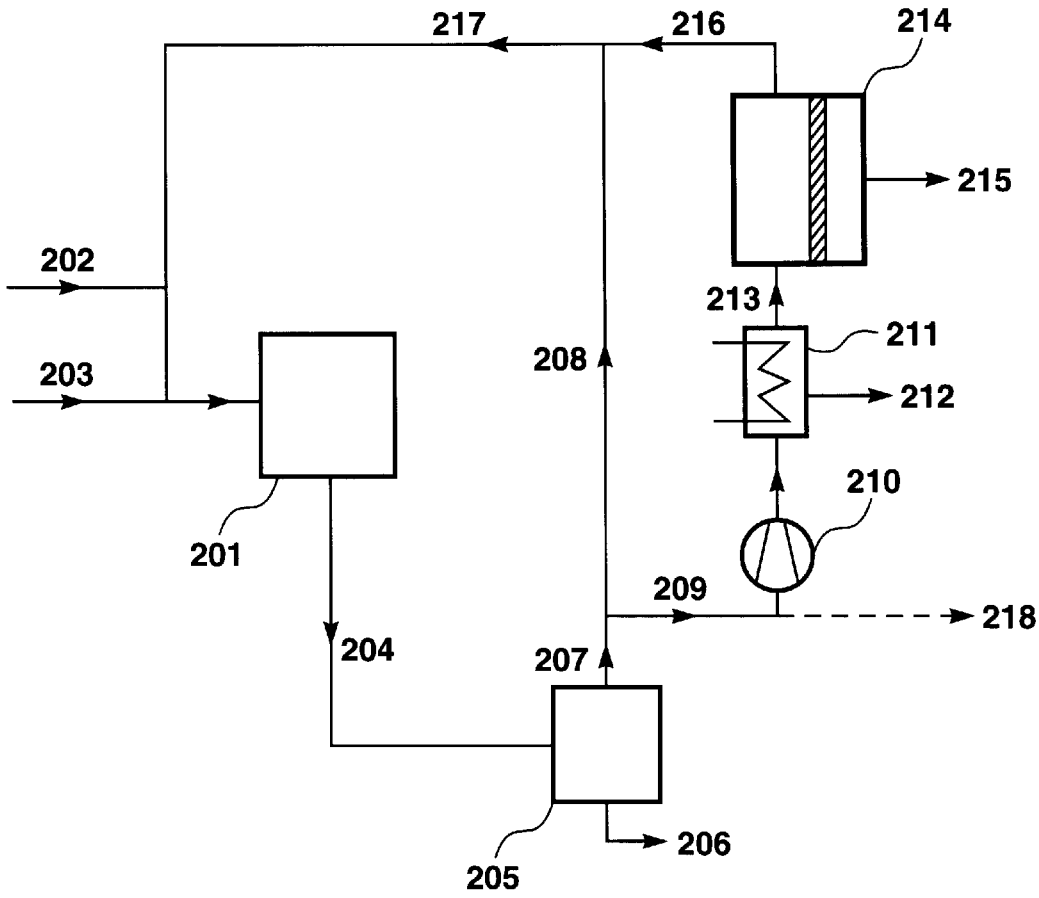
FIG. 2 is a schematic drawing showing an embodiment of the invention in which the feed to the membrane modules is compressed.

FIG. 2 shows an embodiment of the invention in which the feed stream is compressed before passing to the membrane separation unit. Referring to this figure, box 201 represents the reactor, which may be of any type as described with respect to FIG. 1. Streams 203, the hydrocarbon stream, 202, the fresh hydrogen stream and 217, the recycle stream are brought to the desired conditions and passed into the reactor. Effluent stream 204 is withdrawn and enters phase separation step 205, which can be executed in any convenient manner, as described for FIG. 1 above. Liquid phase, 206, is withdrawn. Vapor phase, 207, is divided into two streams, 209, which is passed to the membrane separation step, 214, and 208, which bypasses the membrane separation step and is recirculated without further separation and with optional booster recompression, not shown, to the reactor. If desired, an optional additional direct purge cut may be taken as shown by dashed line 218, and sent directly to downstream treatment or use, without passing through the membrane treatment step. Before entering the membrane modules, stream 209 is raised in pressure by passing through compressor 210. In this case, it is assumed that stream 209 is sufficiently rich in components of relatively high boiling point, such as $C_{3+}$ hydrocarbons, that compression followed by cooling in heat exchanger or chiller, 211, knocks out a further liquid fraction, 212. This additional heavier hydrocarbon enriched liquid product can be mixed with stream 206, added to other NGL sources in the plant, or otherwise handled as desired. The remainder of the stream, still in vapor form, passes on as stream 213 to the membrane separation unit. The unit produces purge stream 215, enriched in contaminants and depleted in hydrogen, and residue stream 216, which is mixed with stream 208 to form recycle stream 217. As a variant of the FIG. 2 embodiment, stream 215 can be returned to the inlet side of compressor 210. In this case, the purge is removed entirely as stream 212, or by streams 212 and 218, if present.

In designs such as FIG. 2, purge stream 215 is depleted both in hydrogen and in $C_{3+}$ hydrocarbons compared with stream 209, because some of the more condensable hydrocarbons exit the loop at stream 212. This has the effect of considerably reducing both the volume and the Btu value of the gas purged from the loop, compared with the case if stream 209 were to be purged without treatment. This result is particularly useful in plants where reactor throughput was previously limited by fuel gas production. The generation of less and lighter fuel gas enable the reactor space velocity to be increased, and thus provides a debottlenecking capability.

Embodiments of this type can be used conveniently to retrofit a prior art system by adding the membrane separation unit and optionally the other components in the side loop from line 209 to line 216. Such embodiments provide versatility to adapt to variable compositions and flow rates of stream 207 by diverting greater or lesser proportions of the stream through bypass line 208. They also provide for the membrane separation system to be taken off-line for maintenance or repair without having to shut down the reactor.

Figure 3:
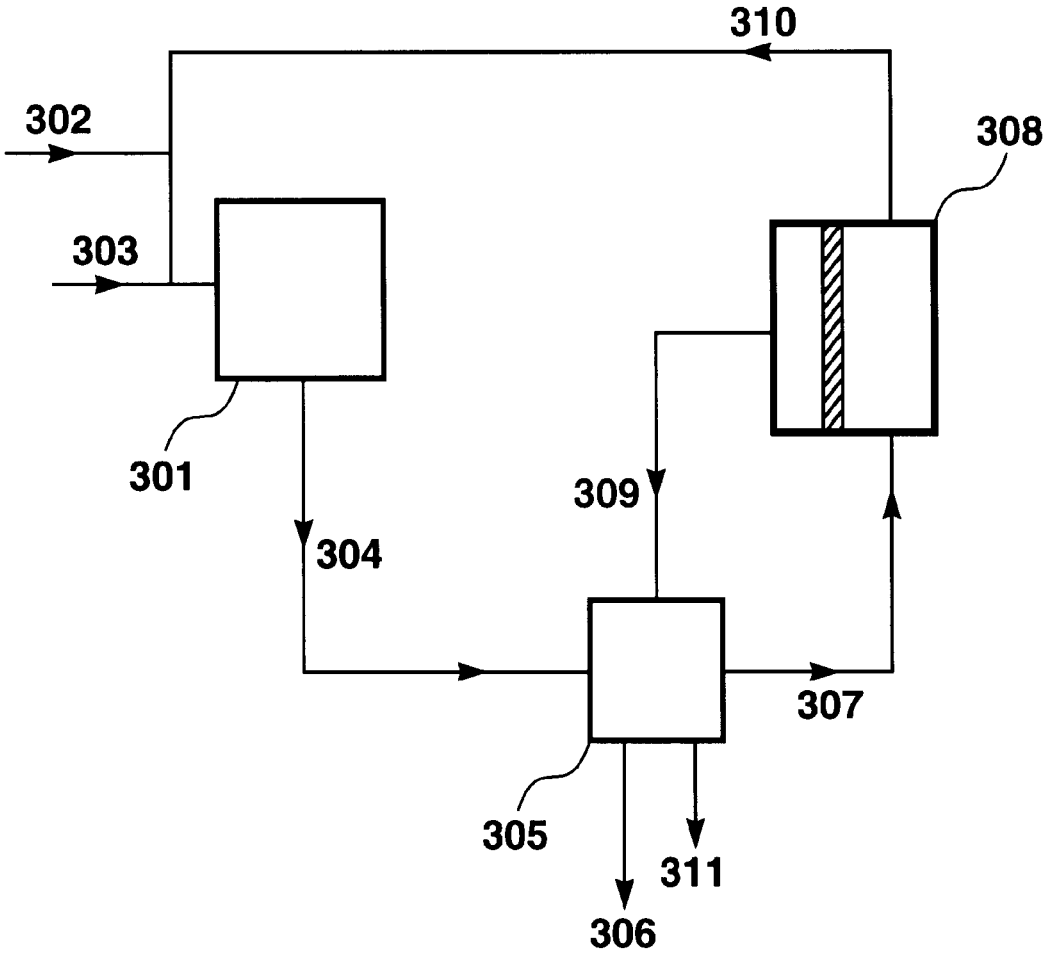
FIG. 3 is a schematic drawing showing an embodiment of the invention in which the membrane permeate stream is recirculated within the reactor loop.

FIG. 3 shows an embodiment in which the permeate stream is not removed from the loop directly, but is passed back to the phase separation step and withdrawn there. Such an embodiment is useful, for example but not only, when hydrogen sulfide is the principal contaminant of concern. Describing the figure by way of this illustration, reactor 301 is a hydrodesulfurization unit operating on a cut from the atmospheric or vacuum distillation columns.

Figure 5:
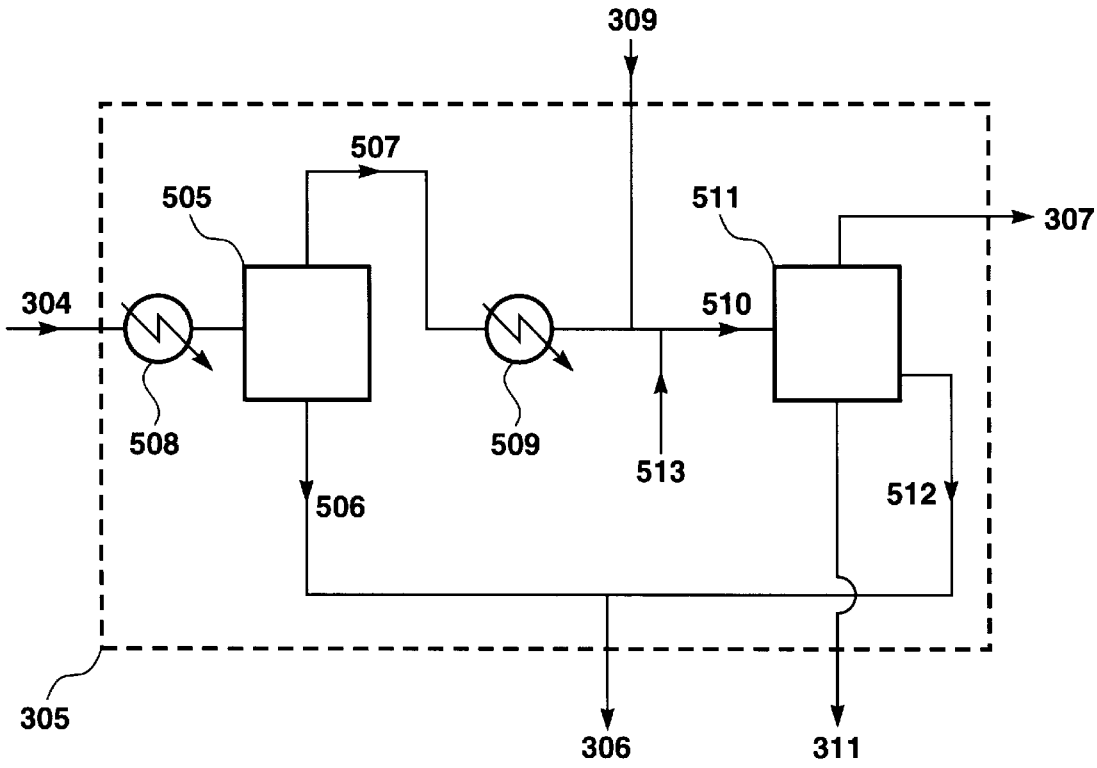
FIG. 5 is a schematic drawing showing an embodiment of the phase separation step of FIG. 3 in more detail.

Streams 303, the sulfur-laden feed; 302, the fresh hydrogen stream; and 310, the recycle stream are brought to the desired conditions and passed into the reactor. Effluent stream 304 contains hydrogen sulfide that has been formed in the reactor, in addition to hydrocarbons and other materials, depending on the source of the feed and the specifics of the reaction. This stream passes into phase separation step 305. FIG. 5 shows the phase separation step 305, indicated overall by the dashed line, broken down in more detail, as might be appropriate to the hydrodesulfurization case. Referring to FIG. 5, stream 304 is cooled, 508, by heat exchange or otherwise and passes into first, high temperature separator, 505, yielding liquid stream 506 and vapor stream 507. Vapor stream 507 is cooled, 509, to a lower temperature and is mixed with permeate purge stream 309 from the membrane separation step. The stream is washed by introducing water stream, 513 and passes as stream 510 into low temperature separator 511. This is a three phase separator of any type, as is well known in the art. Hydrogen sulfide contained in the stream is readily dissolved in the water that has been introduced, as is ammonia, which is often present as an additional contaminant. The resulting sour water stream is withdrawn as purge stream 311. The organic liquid phase from the separator is withdrawn as stream 512, and combined with the organic liquid from the high temperature separator to form organic liquid phase 306. The vapor phase, 307, is withdrawn from the low temperature separator.

Returning to FIG. 3, stream 307, containing any hydrogen sulfide that was not captured by the water wash, passes into membrane separation step, 308. In this case, it is optional, but preferred, to use a polyamide-polyether block copolymer as the selective membrane material. The membrane permeates hydrogen sulfide, hydrocarbons and ammonia faster than hydrogen, yielding a permeate purge stream, 309, that is selectively enriched in acid gas and hydrocarbons. This stream is then passed back to the phase separation step as already discussed and shown in FIG. 5. In this manner, two particular benefits are obtained: one, the membrane provides additional selective purging of the hydrogen sulfide, and two, the recovery of liquid hydrocarbons is increased. The membrane residue stream, 310, is recirculated to the inlet of the reactor.

It will be appreciated that the configuration of FIG. 3 can also be used for removal of contaminants other than hydrogen sulfide, for example, carbon dioxide, ammonia or specific hydrocarbons, and can involve other separation techniques than water scrubbing, for example amine absorption, lean oil absorption or stripping.

Figure 4:
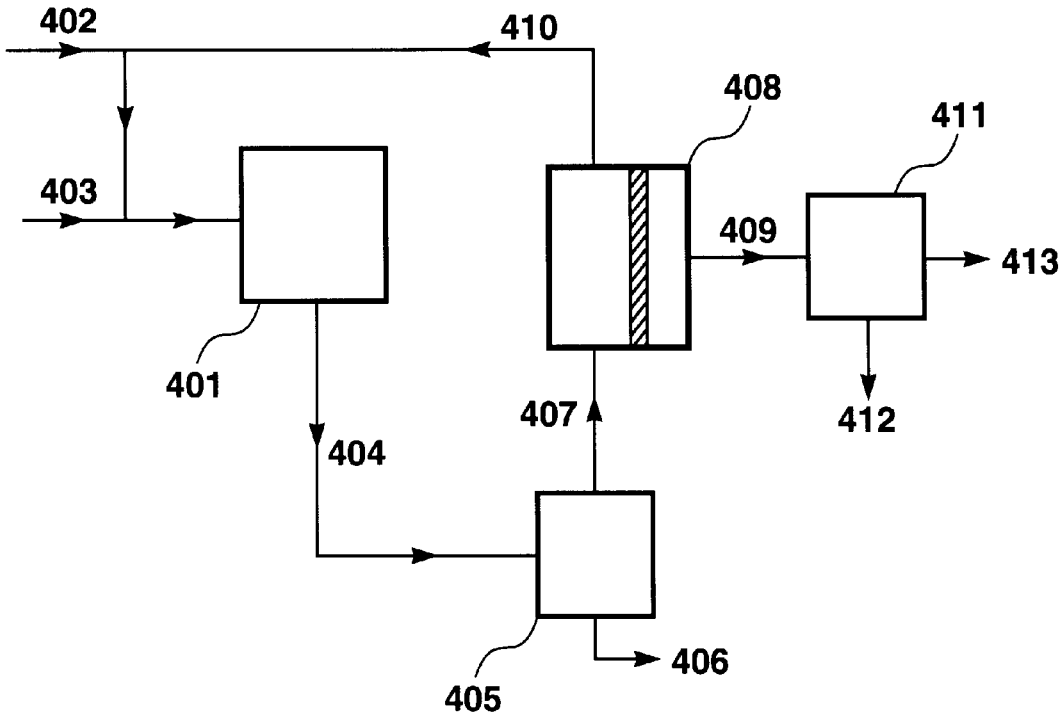
FIG. 4 is a schematic drawing showing an embodiment of the invention in which the membrane permeate stream is subjected to additional treatment.

FIG. 4 shows an embodiment in which the permeate purge stream is subjected to further treatment. In this case, box 401 represents the reactor. Streams 403, the hydrocarbon stream; 402, the fresh hydrogen stream; and 410, the recycle stream are brought to the desired conditions and passed into the reactor. Effluent stream 404 is withdrawn and enters phase separation step 405. Liquid phase, 406, is withdrawn. Vapor phase, 407, passes to the membrane separation step, 408, and is separated into permeate purge stream, 409, enriched in contaminants and depleted in hydrogen, and residue stream 410, which is recirculated. Permeate stream 409 passes into additional treatment step, 411. This step may take diverse forms, depending on the content of stream 409 and the environment of use, and could be, by way of non-limiting example: absorption, such as into water, amine solution or hydrocarbon liquid; adsorption, such as pressure swing adsorption; distillation, including fractionation into multiple components and splitting into a top and bottom product; stripping, such as by steam or light hydrocarbons; flashing; and membrane separation, using similar or dissimilar membranes to those used in the membrane separation step. Thus, the content of streams 412 and 413 will vary. In general, stream 412 indicates a stream that is richer in heavier hydrocarbons than stream 409 and stream 413 indicates a stream that is leaner.

Although essentially any treatment is possible, two destinations for stream 409 will commonly be both appropriate and convenient. First, the stream may be passed to the saturated or unsaturated gas plant, depending on whether olefins are present, for splitting with other off-gas streams from the refinery into separate $C_2$–$C_5$ fractions. Second, since the permeate stream is particularly enriched in the heavier hydrocarbon components of stream 407, it can be added to liquid stream 406 from the phase separation step, thereby increasing the liquids recovery. For example, in hydrodealkylation of toluene to benzene, the liquids from the phase separator are often passed to a stripper, where a light hydrocarbon stream is used to strip out other light hydrocarbons, and whence the heavier liquid bottom stream passes on to be fractionated into lights, benzene, and heavier aromatics for recycle. In this situation, it is convenient to pass stream 409 to the stripping step, to increase benzene yield and recovery of heavier aromatics for return to the reactor. In hydrocracking, the liquids from the phase separators are sometimes passed through a steam stripper to remove light components before passing the oil into a fractionator. Stream 409 can be added to the feed to the steam stripper in this case. In isomerization plants, a stabilizer column or light aromatics tower is frequently employed to remove a light hydrocarbon overhead before the isomer product stream is sent for splitting, and stream 409 may form part of the feed to the column.

The invention is now further described by the following examples, which are intended to be illustrative of the invention, but are not intended to limit the scope or underlying principles in any way.

EXAMPLES

Examples 1–3

Comparative calculations were carried out to contrast the performance of the invention with prior art unselective purging. The calculations were performed using a modeling program, ChemCad III(ChemStations, Inc., Houston, Tex.), to simulate the treatment of a typical off-gas stream from a phase separator of a hydrocracker process.

The off-gas stream from the phase separator was assumed to have a flow rate of 50 MMscfd, to be at a temperature of 50° C. and a pressure of 1,800 psia, and have the following composition:

| | |
|---|---|
| Hydrogen | 74.5% |
| Methane | 17.5% |
| Ethane | 6.5% |
| Propane | 1.5% |

Example 1

Not in Accordance with the Invention

The prior art process was assumed to be carried out simply by withdrawing 8%, or 4 MMscfd, of gas from the separator overhead, and recirculating the remaining 46 MMscfd to the reactor. The compositions of the purge gas and recycle gas streams are, of course, the same in the unselective purge process. The results of the calculations are shown in Table 1.

TABLE 1

| Component/Parameter | Separator Off-Gas | Recycle Stream | Purge Stream |
|---|---|---|---|
| Molar Flow Rate (lbmol/h) | 5,803 | 5,338 | 464 |
| Mass Flow Rate (lb/h) | 40,185 | 36,970 | 3,215 |
| Temperature (° C.) | 50 | 50 | 50 |
| Pressure (psia) | 1,800 | 1,800 | 1,800 |
| Component (mol %) | | | |
| Hydrogen | 74.5 | 74.5 | 74.5 |
| Methane | 17.5 | 17.5 | 17.5 |
| Ethane | 6.5 | 6.5 | 6.5 |
| Propane | 1.5 | 1.5 | 1.5 |
| Component (lb/h) | | | |
| Hydrogen | 8,714 | 8,017 | 697 |
| Methane | 16,291 | 14,988 | 1,302 |
| Ethane | 11,342 | 10,434 | 907 |
| Propane | 3,838 | 3,531 | 307 |

In this case, the purge removed about 2,500 lb/h of hydrocarbons (1,302 lb/h methane, 907 lb/h ethane, and 307 lb/h propane) from the loop, with a concomitant loss of about 700 lb/h of hydrogen.

Example 2

A computer calculation was performed to simulate the process of the invention applied to the same off-gas stream as in Example 1. The treatment process was assumed to be carried out according to the process design shown in FIG. 1, with no gas discharged through optional purge line 111; that is, all of stream 107 sent to the membrane unit for treatment. The calculation was carried out to produce a total hydrocarbon removal of about 2,500 lb/h, as in the unselective purge process of Example 1.

Membrane pressure-normalized fluxes were assumed to be as follows, as are typical of a silicone rubber membrane:

| | |
|---|---|
| Hydrogen | $100 \times 10^{-6}$ cm$^3$(STP)/cm$^2$ · sec · cmHg |
| Methane | $140 \times 10^{-6}$ cm$^3$(STP)/cm$^2$ · sec · cmHg |
| Ethane | $350 \times 10^{-6}$ cm$^3$(STP)/cm$^2$ · sec · cmHg |
| Propane | $600 \times 10^{-6}$ cm$^3$(STP)/cm$^2$ · sec · cmHg |

The results of the calculations are shown in Table 2. The stream numbers correspond to FIG. 1.

TABLE 2

| Component/Parameter | Stream 107 (Off-Gas Stream) | Stream 110 (Recycle Stream) | Stream 109 (Permeate Stream) |
|---|---|---|---|
| Molar Flow Rate (lbmol/h) | 5,803 | 5,560 | 243 |
| Mass Flow Rate (lb/h) | 40,185 | 37,329 | 2,856 |
| Temperature (° C.) | 50 | 49 | 49 |
| Pressure (psia) | 1,800 | 1,800 | 50 |

TABLE 2-continued

| Component/Parameter | Stream 107 (Off-Gas Stream) | Stream 110 (Recycle Stream) | Stream 109 (Permeate Stream) |
|---|---|---|---|
| Component (mol %) | | | |
| Hydrogen | 74.5 | 75.2 | 58.7 |
| Methane | 17.5 | 17.4 | 19.0 |
| Ethane | 6.5 | 6.1 | 16.4 |
| Propane | 1.5 | 1.3 | 5.9 |
| Component (lb/h) | | | |
| Hydrogen | 8,714 | 8,427 | 287 |
| Methane | 16,291 | 15,551 | 740 |
| Ethane | 11,342 | 10,148 | 1,193 |
| Propane | 3,838 | 3,202 | 636 |

Membrane Area = 59 m$^2$

In this case, removal of 2,500 lb/h of hydrocarbons was achieved with a loss of under 300 lb/h of hydrogen, that is, about 40% of the hydrogen loss of the prior art unselective purge. As a result, the hydrogen concentration in the recycle stream is increased from 74.5% to 75.2%.

Example 3

The computer calculation of Example 2 was repeated, except that the membrane area was increased to produce a permeate purge of about 1,300 lb/h of methane, as in the unselective purge process of Example 1. In other words, it was assumed that methane was the principal contaminant of concern.

The feed flow rate, stream composition, and all other conditions were as in Example 2.

The results of the calculations are shown in Table 3. The stream numbers correspond to FIG. 1.

TABLE 3

| Component/Parameter | Stream 107 (Off-Gas Stream) | Stream 110 (Recycle Stream) | Stream 109 (Permeate Stream) |
|---|---|---|---|
| Molar Flow Rate (lbmol/h) | 5,803 | 5,377 | 426 |
| Mass Flow Rate (lb/h) | 40,185 | 32,254 | 4,931 |
| Temperature (° C.) | 50 | 49 | 49 |
| Pressure (psia) | 1,800 | 1,800 | 50 |
| Component (mol %) | | | |
| Hydrogen | 74.5 | 75.7 | 59.2 |
| Methane | 17.5 | 17.4 | 19.1 |
| Ethane | 6.5 | 5.7 | 16.0 |
| Propane | 1.5 | 1.2 | 5.7 |
| Component (lb/h) | | | |
| Hydrogen | 8,714 | 8,206 | 509 |
| Methane | 16,291 | 14,988 | 1,304 |
| Ethane | 11,342 | 9,290 | 2,052 |
| Propane | 3,838 | 2,772 | 1,066 |

Membrane Area = 104 m$^2$

This process design results in a loss of about 500 lb/h of hydrogen, or 70% of the hydrogen loss of the unselective purge process of Example 1. Because the membrane has a higher selectivity for ethane and propane over hydrogen than for methane over hydrogen, the ethane and propane removal in this case is higher than in Example 2, so the total hydrocarbon removal increases to over 4,400 lb/h. These hydrocarbons provide increased NGL production. In addition, the hydrogen concentration in the hydrogen recycle stream is increased by 1.2%.

Examples 4–8

Comparative calculations were carried out to contrast the performance of the invention with prior art unselective purging in treatment of a hydrotreater off-gas. The calculations were performed using a modeling program, ChemCad III (ChemStations, Inc., Houston, Tex.). The effluent from the hydrotreater was assumed to be passed to a first phase separator, then further cooled, mixed with wash water and passed to a three-phase separator. A portion of the overhead from the three-phase separator was assumed to be withdrawn as a purge stream.

The hydrotreater was assumed to be processing 100,000 lb/h of hydrocarbon feedstock, to produce 118,000 lb/h of raw effluent at 970 psia and 329° C. The composition of this raw effluent stream (stream 304) varies slightly from calculation to calculation, but is appproximately as follows:

| | |
|---|---|
| Water vapor | 0.2% |
| Hydrogen | 60.0% |
| Hydrogen Sulfide | 4.5% |
| Ammonia | 0.3% |
| Methane | 15.0% |
| Ethane | 1.3% |
| $C_{3+}$ hydrocarbons | 19.1% |

Example 4

Not in Accordance with the Invention

A computer calculation was performed for the prior art, unselective purge case. The process design was assumed to be as in FIGS. 3 and 5, but with the purge simply withdrawn directly from line 307, without passing through a membrane unit. A purge cut of 2% (47 lbmol/h: 2,243 lbmol/h) of the total stream was taken.

The results of the calculations are shown in Table 4. The stream numbers correspond to FIGS. 3 and 5, without the membrane unit.

TABLE 4

| Component/ Parameter | Stream 303 | Stream 304 | Stream 302 | Recycle Stream | Stream 506 | Stream 512 | Stream 307 | Purge Stream |
|---|---|---|---|---|---|---|---|---|
| Molar Flow Rate (lbmol/h) | 469.3 | 2,844 | 280.0 | 2,196 | 600.2 | 1.6 | 2,243 | 47.0 |
| Mass Flow Rate (lb/h) | 100,000 | 118,001 | 1,252 | 16,748 | 100,699 | 206.8 | 17,106 | 358.6 |
| Temperature (° C.) | 49 | 329 | 313 | 49 | 133 | 49 | 49 | 49 |
| Pressure (psia) | 1,050 | 970 | 1,050 | 935 | 940 | 935 | 935 | 935 |
| Component (mol %) | | | | | | | | |
| Water | 0.0 | 0.2 | 0.0 | 0.2 | 0.1 | 0.2 | 0.2 | 0.2 |
| Hydrogen | 0.0 | 58.2 | 87.5 | 72.7 | 4.2 | 3.6 | 72.7 | 72.7 |
| Hydrogen Sulfide | 0.0 | 5.2 | 0.0 | 5.4 | 4.1 | 11.6 | 5.4 | 5.4 |
| Ammonia | 0.0 | 0.3 | 0.0 | 0.3 | 0.3 | 0.9 | 0.3 | 0.3 |
| Methane | 0.3 | 15.2 | 9.8 | 18.4 | 3.3 | 5.0 | 18.4 | 18.4 |
| Ethane | 0.3 | 1.3 | 1.3 | 1.5 | 0.8 | 1.8 | 1.5 | 1.5 |
| $C_{3+}$ | 99.4 | 19.6 | 1.3 | 1.4 | 87.2 | 77.0 | 1.4 | 1.4 |
| Component (lb/h) | | | | | | | | |
| Hydrogen | 0.0 | 3,338 | 494 | 3,218 | 51 | 0.1 | 3,287 | 69 |
| Hydrogen Sulfide | 0.0 | 4,995 | 0.0 | 4,056 | 847 | 6.2 | 4,143 | 87 |
| Methane | 18.5 | 6,948 | 440 | 6,489 | 319 | 1.3 | 6,628 | 139 |

Actual Horsepower = 158 + 476 hp

Example 5

The computer calculations were repeated, assuming the invention was carried out according to the process designs of FIGS. 3 and 5. It was assumed, however, that the membrane permeate stream was not recirculated as shown, but was passed instead to downstream treatment. The membrane area and other membrane process parameters were assumed to be adjusted to keep the methane purge rate the same as in Example 4. The feed flow rate, approximate feed composition, temperature, and pressure were assumed to be the same as in Example 4.

Membrane pressure-normalized fluxes were assumed to be as follows, as are typical of a silicone rubber membrane:

| | |
|---|---|
| Water | $1{,}000 \times 10^{-6}$ cm$^3$(STP)/cm$^2$ · sec · cmHg |
| Hydrogen | $75 \times 10^{-6}$ cm$^3$(STP)/cm$^2$ · sec · cmHg |
| Hydrogen Sulfide | $500 \times 10^{-6}$ cm$^3$(STP)/cm$^2$ · sec · cmHg |
| Ammonia | $800 \times 10^{-6}$ cm$^3$(STP)/cm$^2$ · sec · cmHg |
| Methane | $100 \times 10^{-6}$ cm$^3$(STP)/cm$^2$ · sec · cmHg |
| Ethane | $200 \times 10^{-6}$ cm$^3$(STP)/cm$^2$ · sec · cmHg |
| Propane | $300 \times 10^{-6}$ cm$^3$(STP)/cm$^2$ · sec · cmHg |
| $C_{6+}$ hydrocarbons | $700 \times 10^{-6}$ cm$^3$(STP)/cm$^2$ · sec · cmHg |

The results of the calculations are shown in Table 5. The stream numbers correspond to FIGS. 3 and 5.

TABLE 5

| Component/ Parameter | Stream 303 | Stream 304 | Stream 302 | Stream 310 (Recycle) | Stream 506 | Stream 512 | Stream 307 | Stream 309 (Vent) |
|---|---|---|---|---|---|---|---|---|
| Molar Flow Rate (lbmol/h) | 469.3 | 2,844 | 280.0 | 2,203 | 592.8 | 1.5 | 2,251 | 47.9 |
| Mass Flow Rate (lb/h) | 100,000 | 116,561 | 1,252 | 15,357 | 100,438 | 198.1 | 15,942 | 584.4 |
| Temperature (° C.) | 49 | 329 | 313 | 49 | 133 | 49 | 49 | 48 |
| Pressure (psia) | 1,050 | 970 | 1,050 | 930 | 940 | 935 | 935 | 50 |
| Component (mol %) | | | | | | | | |
| Water | 0.0 | 0.2 | 0.0 | 0.2 | 0.1 | 0.2 | 0.2 | 1.0 |
| Hydrogen | 0.0 | 60.2 | 87.5 | 75.3 | 4.3 | 3.7 | 74.9 | 59.9 |
| Hydrogen Sulfide | 0.0 | 4.3 | 0.0 | 4.3 | 3.4 | 9.7 | 4.5 | 14.1 |
| Ammonia | 0.0 | 0.2 | 0.0 | 0.2 | 0.2 | 0.7 | 0.3 | 1.0 |
| Methane | 0.3 | 14.5 | 9.8 | 17.5 | 3.1 | 4.8 | 17.5 | 17.9 |
| Ethane | 0.3 | 1.2 | 1.3 | 1.3 | 0.7 | 1.6 | 1.3 | 2.4 |
| $C_{3+}$ | 99.4 | 19.5 | 1.3 | 1.2 | 88.2 | 79.2 | 1.2 | 3.8 |
| Component (lb/h) | | | | | | | | |
| Hydrogen | 0.0 | 3,452 | 494 | 3,342 | 51.8 | 0.1 | 3,400 | 57.8 |
| Hydrogen Sulfide | 0.0 | 4,127 | 0.0 | 3,198 | 694 | 4.9 | 3,429 | 231 |
| Methane | 18.5 | 6,610 | 440 | 6,172 | 299 | 1.1 | 6,310 | 138 |

Membrane Area = 30 $m^2$
Actual Horsepower = 167 + 476 hp

Example 6

The calculation of Example 5 was repeated, this time keeping the hydrogen sulfide purge rate the same as in Example 4. The membrane fluxes were as in Example 5.

The results of the calculations are shown in Table 6. The stream numbers correspond to FIGS. 3 and 5.

TABLE 6

| Component/ Parameter | Stream 303 | Stream 304 | Stream 302 | Stream 310 (Recycle) | Stream 506 | Stream 512 | Stream 307 | Stream 309 (Vent) |
|---|---|---|---|---|---|---|---|---|
| Molar Flow Rate (lbmol/h) | 469.3 | 2,844 | 280.0 | 2,233 | 597.3 | 1.5 | 2,246 | 13.5 |
| Mass Flow Rate (lb/h) | 100,000 | 117,457 | 1,252 | 16,474 | 100,597 | 204.0 | 16,665 | 191.1 |
| Temperature (° C.) | 49 | 329 | 313 | 49 | 133 | 49 | 49 | 49 |
| Pressure (psia) | 1,050 | 970 | 1,050 | 930 | 940 | 935 | 935 | 50 |
| Component (mol %) | | | | | | | | |
| Water | 0.0 | 0.2 | 0.0 | 0.2 | 0.1 | 0.2 | 0.2 | 1.3 |
| Hydrogen | 0.0 | 59.0 | 87.5 | 73.7 | 4.3 | 3.6 | 73.5 | 54.1 |
| Hydrogen Sulfide | 0.0 | 4.8 | 0.0 | 5.0 | 3.9 | 10.8 | 5.0 | 18.7 |
| Ammonia | 0.0 | 0.3 | 0.0 | 0.3 | 0.2 | 0.8 | 0.3 | 1.4 |
| Methane | 0.3 | 15.0 | 9.8 | 18.1 | 3.2 | 4.9 | 18.1 | 17.4 |
| Ethane | 0.3 | 1.3 | 1.3 | 1.4 | 0.7 | 1.7 | 1.4 | 2.6 |
| $C_{3+}$ | 99.4 | 19.6 | 1.3 | 1.4 | 87.6 | 78.0 | 1.4 | 4.6 |
| Component (lb/h) | | | | | | | | |
| Hydrogen | 0.0 | 3,381 | 494 | 3,315 | 51 | 0.1 | 3,330 | 15 |
| Hydrogen Sulfide | 0.0 | 4,649 | 0.0 | 3,771 | 785 | 5.7 | 3,857 | 86 |
| Methane | 18.5 | 6,829 | 440 | 6,477 | 311 | 1.2 | 6,514 | 38 |

Membrane Area = 8 $m^2$
Actual Horsepower = 169 + 476 hp

Example 7

The calculation of Example 5 was repeated, this time keeping the hydrogen purge rate the same as in Example 4. The membrane fluxes were as in Example 5.

The results of the calculations are shown in Table 7. The stream numbers correspond to FIGS. 3 and 5.

TABLE 7

| Component/ Parameter | Stream 303 | Stream 304 | Stream 302 | Stream 310 (Recycle) | Stream 506 | Stream 512 | Stream 307 | Stream 309 (Vent) |
|---|---|---|---|---|---|---|---|---|
| Molar Flow Rate (lbmol/h) | 469.3 | 2,844 | 280.0 | 2,196 | 592.2 | 1.5 | 2,251 | 55.8 |
| Mass Flow Rate (lb/h) | 100,000 | 116,435 | 1,252 | 15,180 | 100,415 | 197.5 | 15,841 | 660.5 |
| Temperature (° C.) | 49 | 329 | 313 | 49 | 133 | 49 | 49 | 47 |
| Pressure (psia) | 1,050 | 970 | 1,050 | 930 | 940 | 935 | 935 | 50 |
| Component (mol %) | | | | | | | | |
| Water | 0.0 | 0.2 | 0.0 | 0.2 | 0.1 | 0.2 | 0.2 | 0.9 |
| Hydrogen | 0.0 | 60.4 | 87.5 | 75.5 | 4.3 | 3.7 | 75.1 | 60.9 |
| Hydrogen Sulfide | 0.0 | 4.2 | 0.0 | 4.2 | 3.4 | 9.6 | 4.4 | 13.4 |
| Ammonia | 0.0 | 0.2 | 0.0 | 0.2 | 0.2 | 0.7 | 0.2 | 0.9 |
| Methane | 0.3 | 14.4 | 9.8 | 17.4 | 3.1 | 4.8 | 17.4 | 18.0 |
| Ethane | 0.3 | 1.2 | 1.3 | 1.3 | 0.7 | 1.6 | 1.3 | 2.3 |
| $C_{3+}$ | 99.4 | 19.5 | 1.3 | 1.2 | 87.2 | 79.4 | 1.2 | 3.5 |
| Component (lb/h) | | | | | | | | |
| Hydrogen | 0.0 | 3,462 | 494 | 3,341 | 52 | 0.1 | 3,410 | 69 |
| Hydrogen Sulfide | 0.0 | 4,058 | 0.0 | 3,118 | 681 | 4.8 | 3,372 | 254 |
| Methane | 18.5 | 6,578 | 440 | 6,119 | 297 | 1.1 | 6,280 | 162 |

Membrane Area = 36 $m^2$
Actual Horsepower = 167 + 476 hp

Example 8

Comparison of Examples 4–7

The degree of hydrogen sulfide removal and the loss of hydrogen from the hydrogen recycle stream to the reactor was compared for the unselective purge process of Example 4 and the membrane processes of Examples 5–7. The results are shown in Table 8.

TABLE 8

| Example # | $H_2$ Loss (lb/h) | $H_2S$ Removed (lb/h) | $CH_4$ Removed (lb/h) | $H_2$ in Recycle (mol %) | $H_2S$ in Recycle (mol %) | Membrane Area ($m^2$) | Actual Comp Horsepower (hp) |
|---|---|---|---|---|---|---|---|
| 4 (Unselective Purge) | 68.9 | 86.8 | 138.9 | 72.7 | 5.4 | — | 158 + 476 |
| 5 (Same Methane Purge) | 57.8 | 230.9 | 137.8 | 75.3 | 4.3 | 30 | 167 + 476 |
| 6 (Same $H_2S$ Purge) | 14.7 | 85.6 | 37.6 | 73.7 | 5.0 | 8 | 169 + 476 |
| 7 (Same Hydrogen Purge) | 68.6 | 253.9 | 161.5 | 75.5 | 4.2 | 36 | 167 + 476 |

As can be seen in Table 8, the unselective purge process of Example 4 results in a loss of about 70 lb/h of hydrogen in the purge stream and maintains a hydrogen concentration of 72.7% and a hydrogen sulfide concentration of 5.4% in the recycle loop.

When the process of the invention is carried out to produce a methane removal of about 140 lb/h as in Example 4, there is a nearly three-fold increase in removal of hydrogen sulfide. In addition, the hydrogen loss is reduced from about 69 lb/h to 58 lb/h, and the hydrogen concentration in the recycle stream is increased 2.6%.

When the process of the invention is carried out to produce a hydrogen sulfide removal of about 86 lb/h as in Example 4, the hydrogen loss is reduced to only 21% of that of the unselective purge process. This results in a 1.0% increase in the concentration of hydrogen in the recycle stream.

When the process of the invention is carried out to produce a hydrogen loss of about 69 lb/h as in Example 4, there is a full three-fold increase in removal of hydrogen sulfide, and the concentration of hydrogen in the recycle stream is increased by 2.8%. There is also a 16% increase in the methane removal over the unselective purge process.

The greatest hydrogen recovery is achieved in the case of the same hydrogen sulfide removal as in the unselective purge. However, this process does not remove much methane from the recycle stream. The best hydrogen sulfide removal is achieved in the case of the same hydrogen loss as in the unselective purge. This process also achieves the best methane removal and the highest hydrogen concentration in the recycle stream. Thus, it will be apparent to those skilled in the art that the process of the invention can be tailored to meet the needs of the various refinery operations at any given time.

Examples 9–15

Comparative calculations were carried out to contrast the performance of the invention with prior art unselective purging for controlling the concentration of hydrogen sulfide in a hydrogen recycle stream to a hydrodesulfurization process. The calculations were performed using a modeling program, ChemCad III (ChemStations, Inc., Houston, Tex.), to simulate the treatment of a typical off-gas stream from a phase separator of a hydrodesulfurization process.

The off-gas stream from the phase separator was assumed to have a flow rate of 50 MMscfd, to be at a temperature of 50° C. and a pressure of 700 psia, and and to be of the following approximate volume composition:

| | |
|---|---|
| Hydrogen | 70% |
| Hydrogen Sulfide | 7% |
| Methane | 15% |
| Ethane | 5% |
| n-Butane | 3% |

Example 9

Not in Accordance with the Invention

A calculation was performed for the prior art, unselective purge case. It was assumed that purging was performed simply by withdrawing 7%, or 3.5 MMscfd, of the gas from the phase separator overhead, and recirculating the remainder of the overhead stream to the reactor. In a 50 MMscfd stream, the purging of 3.5 MMscfd of gas results in a removal of about 970 lb/h of hydrogen sulfide. At the same time, about 2.45 MMscfd (570 lb/h) of hydrogen is lost in the purge stream.

Example 10

A series of computer calculations was performed, assuming now that purging was carried out according to the embodiment of the invention as shown in FIG. 4.

Membrane pressure-normalized fluxes were assumed to be as follows, as are typical of a Pebax 4011 membrane:

| | |
|---|---|
| Hydrogen | $5 \times 10^{-6}$ cm$^3$(STP)/cm$^2$ · sec · cmHg |
| Hydrogen Sulfide | $150 \times 10^{-6}$ cm$^3$(STP)/cm$^2$ · sec · cmHg |
| Methane | $5 \times 10^{-6}$ cm$^3$(STP)/cm$^2$ · sec · cmHg |
| Ethane | $10 \times 10^{-6}$ cm$^3$(STP)/cm$^2$ · sec · cmHg |
| n-Butane | $20 \times 10^{-6}$ cm$^3$(STP)/cm$^2$ · sec · cmHg |

Assuming these membrane properties, the membrane permeate stream, 409, contains less than 50% hydrogen sulfide. It was assumed, therefore, that the additional treatment process, 411, consists of two further membrane treatments to raise the hydrogen sulfide concentration to about 90% in stream 412, to facilitate disposal or conversion to elemental sulfur.

Figure 6:
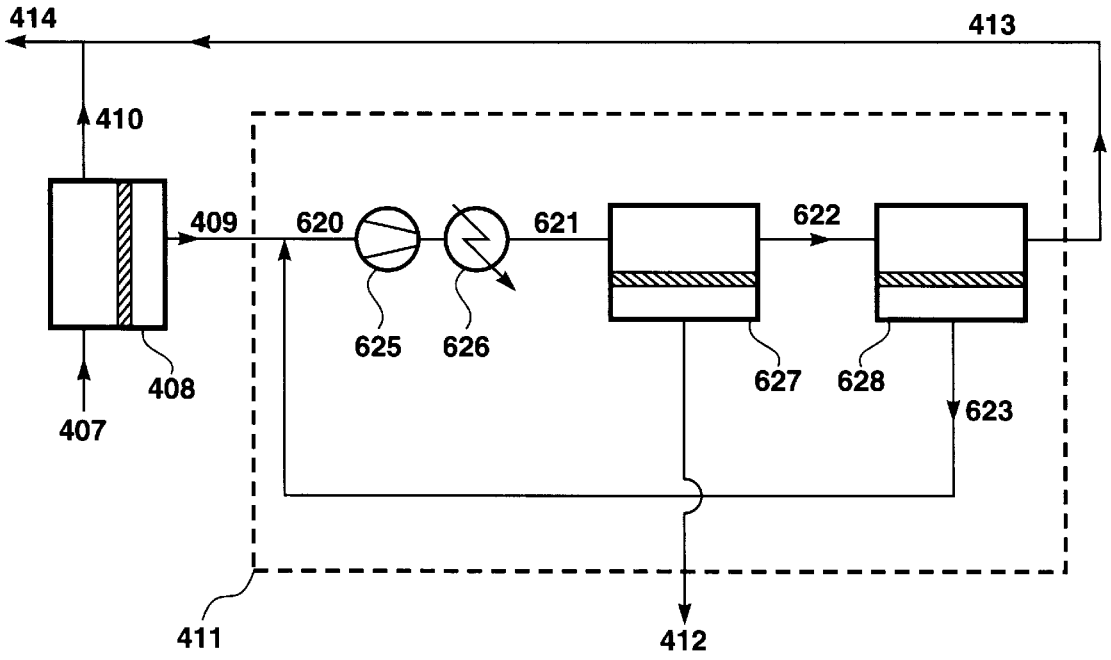
FIG. 6 is a schematic drawing showing an embodiment of the permeate treatment step of FIG. 4 in more detail.

FIG. 6 gives the additional treatment process, 411, indicated overall by the dashed line, broken down in more detail to show how the further membrane treatments are incorporated into the overall scheme.

In FIG. 6, stream 409 is mixed with third membrane permeate stream 623, to form combined stream 620, which is compressed in compressor 625 and cooled in chiller 626. The resultant stream 621, forms the feed to the second membrane unit, 627. This unit produces a concentrated hydrogen sulfide liquid permeate, withdrawn as stream 412, and a hydrogen-sulfide-depleted residue, 622, which passes to a third membrane unit, 628. The third membrane permeate, 623, is combined with first permeate 409 to form stream 620. The hydrogen-enriched third residue stream, 413, is combined with the first residue stream, 410, to form stream 414 for recirculation to the reactor or other use elsewhere in the plant.

Membrane units 627 and 628 were assumed to contain the same Pebax 4011 membranes as unit 408. The membrane area of the membrane units was adjusted to achieve the same hydrogen sulfide removal (970 lb/h) as the prior art case.

The results of the calculations are shown in Table 9. The stream numbers correspond to FIGS. 4 and 6.

TABLE 9

| Stream | 407 | 410 | 409 | 620 | 621 | 412 | 622 | 413 | 414 | 623 |
|---|---|---|---|---|---|---|---|---|---|---|
| Flow (lbmol/h) | 5,803 | 5,741 | 61.9 | 70.8 | 70.8 | 31.2 | 39.6 | 30.7 | 5,771 | 8.9 |
| Mass flow (lb/h) | 54,835 | 53,412 | 1,423 | 1,689 | 1,689 | 1,034 | 654.0 | 388.7 | 53,800 | 265.3 |
| Temp. (° C.) | 50 | 50 | 50 | 49 | 40 | 40 | 40 | 43 | 50 | 43 |
| Pressure (psia) | 700 | 700 | 50 | 50 | 700 | 50 | 700 | 700 | 700 | 50 |
| Component (mol %): | | | | | | | | | | |
| Hydrogen | 70.0 | 70.4 | 33.8 | 31.7 | 31.7 | 4.3 | 53.3 | 63.9 | 70.4 | 16.9 |
| Hydrogen Sulfide | 7.0 | 6.5 | 49.0 | 51.2 | 51.2 | 90.8 | 20.0 | 6.5 | 6.5 | 66.5 |
| Methane | 15.0 | 15.1 | 7.3 | 6.8 | 6.8 | 0.9 | 11.4 | 13.7 | 15.1 | 3.6 |
| Ethane | 5.0 | 5.0 | 4.7 | 4.6 | 4.6 | 1.2 | 7.3 | 8.2 | 5.0 | 4.4 |
| n-Butane | 3.0 | 3.0 | 5.2 | 5.6 | 5.6 | 2.8 | 7.9 | 7.7 | 3.0 | 8.6 |
| Component (lb/h) | | | | | | | | | | |
| Hydrogen | 8,188 | 8,146 | 42.2 | 45.3 | 45.3 | 2.7 | 42.5 | 39.5 | 8,185 | 3.0 |
| Hydrogen Sulfide | 13,841 | 12,807 | 1,034 | 1,235 | 1,235 | 966 | 270 | 68.4 | 12,875 | 201 |

Membrane area = 482 + 50 + 40 m$^2$
Theoretical horsepower = 112 hp

Example 11

The calculation of Example 10 was repeated, except that the membrane area of the membrane units was adjusted to produce a hydrogen recycle stream containing only 6% hydrogen sulfide, instead of 7% as in the prior art case. All other conditions were as in Example 10. The results of the calculations are shown in Table 10.

TABLE 10

| Stream | 407 | 410 | 409 | 620 | 621 | 412 | 622 | 413 | 414 | 623 |
|---|---|---|---|---|---|---|---|---|---|---|
| Flow (lbmol/h) | 5,803 | 5,663 | 139.3 | 161.1 | 161.1 | 68.6 | 92.5 | 70.7 | 5,734 | 21.8 |
| Mass flow(lb/h) | 54,835 | 51,680 | 3,155 | 3,803 | 3,803 | 2,271 | 1,532 | 883.8 | 52,564 | 647.8 |
| Temp. (° C.) | 50 | 50 | 50 | 48 | 33 | 33 | 33 | 43 | 49 | 43 |
| Pressure (psia) | 700 | 700 | 50 | 50 | 700 | 50 | 700 | 700 | 700 | 50 |
| Component (mol %): | | | | | | | | | | |
| Hydrogen | 70.0 | 70.9 | 34.8 | 32.5 | 32.5 | 4.4 | 53.3 | 64.3 | 70.8 | 17.5 |
| Hydrogen Sulfide | 7.0 | 6.0 | 47.6 | 50.0 | 50.0 | 90.5 | 20.0 | 6.0 | 6.0 | 65.5 |
| Methane | 15.0 | 15.2 | 7.5 | 7.0 | 7.0 | 1.0 | 11.4 | 13.8 | 15.2 | 3.7 |
| Ethane | 5.0 | 5.0 | 4.8 | 4.7 | 4.7 | 1.3 | 7.3 | 8.2 | 5.0 | 4.5 |
| n-Butane | 3.0 | 3.0 | 5.3 | 5.8 | 5.8 | 2.8 | 8.0 | 7.7 | 3.0 | 8.8 |
| Component (lb/h) | | | | | | | | | | |
| Hydrogen | 8,188 | 8,090 | 97.8 | 105 | 105 | 6.1 | 99.3 | 91.6 | 8,182 | 7.7 |
| Hydrogen Sulfide | 11,725 | 11,580 | 2,260 | 2,746 | 2,746 | 2,116 | 631 | 145 | 11,725 | 486 |

Membrane area = 1,114 + 112 + 102 $m^2$
Theoretical horsepower = 253 hp

Example 12

The calculation of Example 10 was repeated, except that the membrane area of the membrane units was adjusted to produce a hydrogen recycle stream containing only 5% hydrogen sulfide. All other conditions were as in Example 10. The results of the calculations are shown in Table 11.

TABLE 11

| Stream | 407 | 410 | 409 | 620 | 621 | 412 | 622 | 413 | 414 | 623 |
|---|---|---|---|---|---|---|---|---|---|---|
| Flow (lbmol/h) | 5,803 | 5,511 | 291.9 | 345.6 | 345.6 | 136.8 | 208.9 | 155.1 | 5,666 | 53.7 |
| Mass flow (lb/h) | 54,835 | 48,423 | 6,412 | 7,994 | 7,994 | 4,521 | 3,472 | 1,890 | 50,313 | 1,582 |
| Temp. (° C.) | 50 | 49 | 49 | 48 | 34 | 34 | 34 | 42 | 49 | 42 |
| Pressure (psia) | 700 | 700 | 50 | 50 | 700 | 50 | 700 | 700 | 700 | 50 |
| Component (mol %): | | | | | | | | | | |
| Hydrogen | 70.0 | 71.8 | 36.8 | 34.0 | 34.0 | 4.7 | 53.2 | 65.1 | 71.6 | 18.6 |
| Hydrogen Sulfide | 7.0 | 5.0 | 44.8 | 47.7 | 47.7 | 90.0 | 20.0 | 5.0 | 5.0 | 63.3 |
| Methane | 15.0 | 15.4 | 7.9 | 7.3 | 7.3 | 1.0 | 11.4 | 14.0 | 15.3 | 4.0 |
| Ethane | 5.0 | 5.0 | 5.0 | 5.0 | 5.0 | 1.3 | 7.4 | 8.3 | 5.1 | 4.8 |
| n-Butane | 3.0 | 2.9 | 5.5 | 6.1 | 6.1 | 3.0 | 8.1 | 7.6 | 3.0 | 9.3 |
| Component (lb/h) | | | | | | | | | | |
| Hydrogen | 8,188 | 7,971 | 217 | 237 | 237 | 13.0 | 224 | 204 | 8,175 | 237 |
| Hydrogen Sulfide | 13,841 | 9,387 | 4,454 | 5,613 | 5,613 | 4,190 | 1,423 | 264 | 9,651 | 5,613 |

Membrane area = 2,457 + 233 + 266 $m^2$
Theoretical horsepower = 543 hp

Example 13

The calculation of Example 10 was repeated, except that the membrane area of the membrane units was sized to produce a hydrogen recycle stream containing only 4% hydrogen sulfide. All other conditions were as in Example 10. The results of the calculations are shown in Table 12.

TABLE 12

| Stream | 407 | 410 | 409 | 620 | 621 | 412 | 622 | 413 | 414 | 623 |
|---|---|---|---|---|---|---|---|---|---|---|
| Flow (lbmol/h) | 5,803 | 5,340 | 462.9 | 564.5 | 564.5 | 204.3 | 360.2 | 258.6 | 5,598 | 101.6 |
| Mass flow (lb/h) | 54,835 | 45,028 | 9,807 | 12,761 | 12,761 | 6,743 | 6,018 | 3,063 | 48,091 | 2,954 |
| Temp. (° C.) | 50 | 49 | 49 | 47 | 35 | 35 | 35 | 41 | 48 | 41 |
| Pressure (psia) | 700 | 700 | 50 | 50 | 700 | 50 | 700 | 700 | 700 | 50 |
| Component (mol %): | | | | | | | | | | |
| Hydrogen | 70.0 | 72.7 | 39.1 | 35.6 | 35.6 | 5.0 | 53.0 | 66.0 | 72.4 | 19.9 |
| Hydrogen Sulfide | 7.0 | 4.0 | 41.6 | 45.0 | 45.0 | 89.2 | 20.0 | 4.0 | 4.0 | 60.7 |
| Methane | 15.0 | 15.6 | 8.4 | 7.6 | 7.6 | 1.1 | 11.4 | 14.1 | 15.5 | 4.3 |
| Ethane | 5.0 | 5.0 | 5.3 | 5.2 | 5.2 | 1.4 | 7.4 | 8.3 | 5.1 | 5.2 |
| n-Butane | 3.0 | 2.8 | 5.7 | 6.4 | 6.4 | 3.3 | 8.2 | 7.5 | 3.0 | 9.9 |

TABLE 12-continued

| Stream | 407 | 410 | 409 | 620 | 621 | 412 | 622 | 413 | 414 | 623 |
|---|---|---|---|---|---|---|---|---|---|---|
| Component (lb/h) | | | | | | | | | | |
| Hydrogen | 8,188 | 7,823 | 365 | 406 | 406 | 20.6 | 385 | 344 | 8,167 | 40.8 |
| Hydrogen Sulfide | 13,841 | 7,277 | 6,564 | 8,665 | 8,665 | 6,211 | 2,454 | 352 | 7,629 | 2,101 |

Membrane area = 4,115 + 363 + 534 $m^2$
Theoretical horsepower = 883 hp

Example 14

The calculation of Example 10 was repeated, except that the membrane area of the membrane units was sized to produce a hydrogen recycle stream containing only 3% hydrogen sulfide. All other conditions were as in Example 10. The results of the calculations are shown in Table 13.

TABLE 13

| Stream | 407 | 410 | 409 | 620 | 621 | 412 | 622 | 413 | 414 | 623 |
|---|---|---|---|---|---|---|---|---|---|---|
| Flow (lbmol/h) | 5,803 | 5,136 | 666.4 | 844.8 | 844.8 | 271.8 | 573.0 | 394.5 | 5,531 | 178.4 |
| Mass flow (lb/h) | 54,835 | 41,354 | 13,481 | 18,594 | 18,594 | 8,955 | 9,639 | 4,526 | 45,879 | 5,113 |
| Temp. (° C.) | 50 | 48 | 48 | 46 | 37 | 37 | 37 | 41 | 48 | 41 |
| Pressure (psia) | 700 | 700 | 50 | 50 | 700 | 50 | 700 | 700 | 700 | 50 |
| Component (mol %): | | | | | | | | | | |
| Hydrogen | 70.0 | 73.7 | 41.8 | 37.6 | 37.6 | 5.4 | 52.8 | 66.9 | 73.2 | 21.6 |
| Hydrogen Sulfide | 7.0 | 3.0 | 37.8 | 42.0 | 42.0 | 88.4 | 20.0 | 3.0 | 3.0 | 57.6 |
| Methane | 15.0 | 15.8 | 9.0 | 8.0 | 8.0 | 1.1 | 11.3 | 14.3 | 15.7 | 4.6 |
| Ethane | 5.0 | 4.9 | 5.6 | 5.6 | 5.6 | 1.5 | 7.5 | 8.3 | 5.2 | 5.6 |
| n-Butane | 3.0 | 2.6 | 5.8 | 6.8 | 6.8 | 3.6 | 8.4 | 7.4 | 3.0 | 10.6 |
| Component (lb/h) | | | | | | | | | | |
| Hydrogen | 8,188 | 7,626 | 562 | 639 | 639 | 29.4 | 610 | 532 | 8,158 | 77.6 |
| Hydrogen Sulfide | 13,841 | 5,253 | 8,588 | 12,089 | 12,089 | 8,185 | 3,904 | 403 | 5,656 | 3,501 |

Membrane area = 6,303 + 509 + 1,007 $m^2$
Theoretical horsepower = 1,317 hp

Example 15

Comparison of Examples 9–14

The degree of hydrogen sulfide removal and the loss of hydrogen from the hydrogen recycle steam to the reactor was compared for the unselective purge process of Example 9 and the process of the invention of Examples 10–14. The results are shown in Table 14.

TABLE 14

| Example Number | $H_2S$ in Hydrogen Recycle (%) (Stream 410) | $H_2S$ Removal (lb/h) (Stream 412) | $H_2$ Loss (lb/h) (Stream 412) | Membrane Area ($m^2$) | Theoretical Compressor Horsepower (hp) |
|---|---|---|---|---|---|
| 9 | 7.0 | 967 | 573 | — | — |
| 10 | 6.5 | 966 | 2.7 | 572 | 112 |
| 11 | 6.0 | 2,116 | 6.1 | 1,328 | 253 |
| 12 | 5.0 | 4,190 | 13.0 | 2,956 | 543 |
| 13 | 4.0 | 6,211 | 20.6 | 5,012 | 883 |
| 14 | 3.0 | 8,185 | 29.4 | 7,819 | 1,317 |

Comparing Examples 9 and 10 shows that the invention achieves the same degree of hydrogen sulfide purging as the prior art process, that is about 970 lb/h, with a hydrogen loss of only 3 lb/h, compared with a hydrogen loss of 570 lb/h for the prior art process.

Examples 11–14 show that much higher levels of hydrogen sulfide removal are also possible, combined with extremely low hydrogen losses. These results require larger membrane areas and greater compressor capacity, however.

Thus, it will be apparent to those skilled in the art that the process of the invention can be tailored to meet the needs of the various refinery operations at any given time.

Examples 16–24

Comparative calculations were carried out to contrast the performance of the invention with prior art unselective purging for recovery of hydrogen from catalytic reformers. The calculations were performed using a modeling program ChemCad III (ChemStations, Inc., Houston, Tex.). The effluent from the reformer was assumed to be treated by the following steps, as are common to most reformers:

(a) cool the raw effluent and separate into vapor and raw liquid reformate phases, (b) recirculate part of the vapor to the reformer, (c) recontact unrecirculated vapor against a part of the raw reformate liquid at low temperature and separate into liquid reformate and overhead gas, (d) purge the overhead gas.

The effluent from the reformer reactors was assumed to have a flow rate of approximately 70 MMscfd, to be at a temperature of 510° C. and a pressure of 75 psia, and to have the following composition:

| | |
|---|---|
| Hydrogen | 72.3% |
| Methane | 3.2% |
| Ethane | 2.5% |
| Propane | 6.6% |
| Butanes | 7.9% |
| $C_5$+ | 7.5% |

Figure 7:
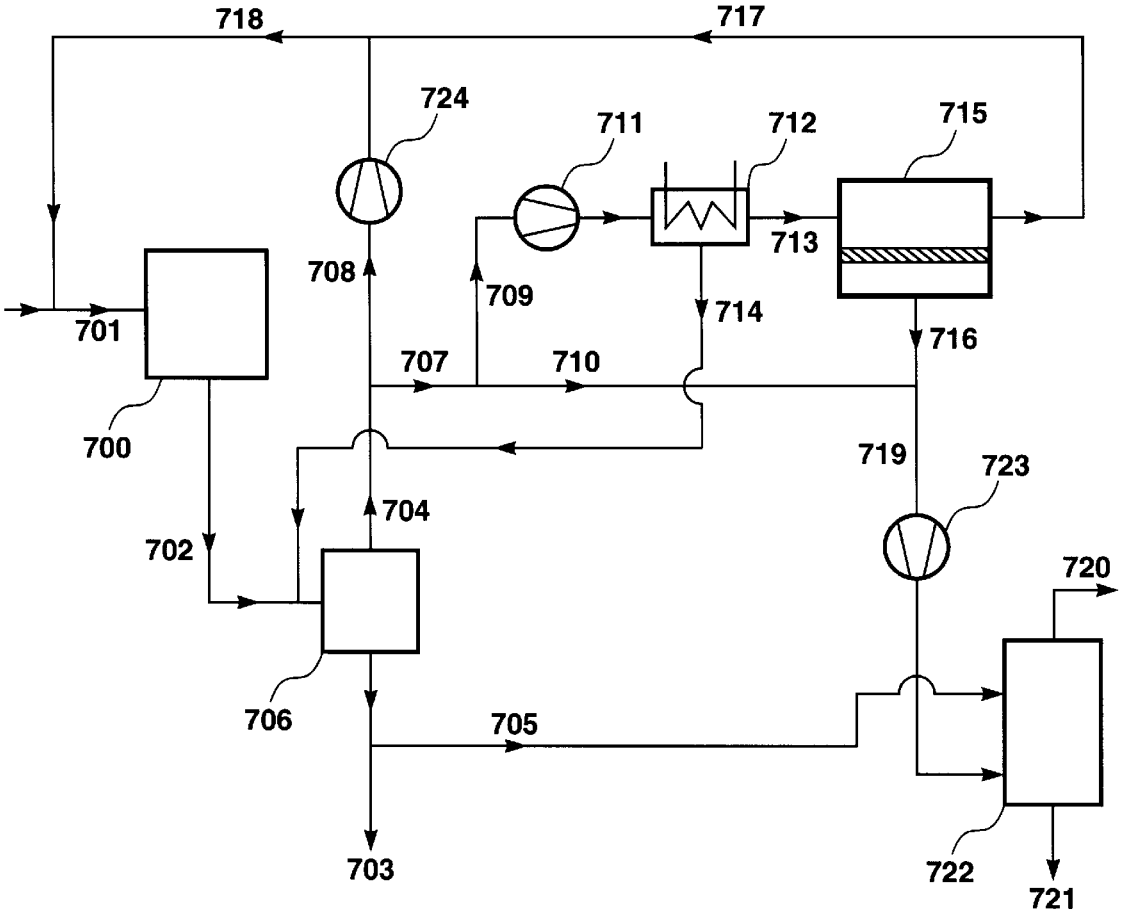
FIG. 7 is a schematic drawing showing an embodiment of the invention treating effluent from a catalytic reformer.

The treatment process was assumed to follow the process scheme of FIG. 7. In FIG. 7, the hydrogen- and hydrocarbon-containing feed stream, 701, is passed to reformer 700. Reformer effluent 702 passes to phase separator 706, which yields a liquid reformate product stream and an off-gas stream, 704. The raw reformate stream is split into two portions-stream 703, which is withdrawn, and stream 705, which is passed to recontactor 722. The off-gas stream is split into a recycle stream, 708, which is directed through booster compressor 724 back to the reformer, and a purge stream, 707. The purge stream itself is split into stream 710, which passes directly to the recontactor, and stream 709, which is diverted for membrane treatment. This stream is compressed in compressor 711 to 300 psia, then cooled in aftercooler/condenser 712. Condensed stream 714 is recirculated to phase separator 706. Uncondensed stream 713 is passed to the membrane unit, 715. A hydrocarbon-enriched permeate is withdrawn as stream 716. This stream is mixed with the untreated purge stream 710, and passed as stream 719 to compressor 723, where it is compressed to 300 psia, and thence into recontactor 722. Membrane residue stream 717 is reduced in pressure to match the output of compressor 724, which was assumed to be at 75 psia, and, combined with compressed stream 708, is recirculated as stream 718 to the reformer.

The recontactor section was assumed to operate at −17° C., with incoming streams 705 and 719 being cooled by heat exchange against outgoing streams and by external chilling, for simplicity not shown in the figure. The recontactor produces a reformate product stream, 721, and a hydrogen-enriched purge gas stream, 720.

Two sub-sets of calculations were performed. For the first sub-set, Examples 16–19, it was assumed that the recontacting of purge vapor and raw reformate is a single-stage operation. For the second sub-set, Examples 20–23, it was assumed that the recontacting is carried out in a multistage column.

Example 16

A computer calculation was performed to simulate the process shown in FIG. 7 and described above, but without the membrane treatment loop, so that all of purge stream 707 passes to the recontactor as in a prior art process. The purge cut was assumed to be 25%, that is, 75% of stream 704 was assumed to be recirculated to the reformer reactors as stream 708 and 25% was assumed to be sent to the recontactor as stream 707.

The results of the calculations are shown in Table 15. Stream numbers correspond to FIG. 7, without the membrane loop.

TABLE 15

| Component/ Parameter | Stream 702 | Stream 704 | Stream 703 | Stream 707 | Stream 710 | Stream 720 | Stream 721 |
|---|---|---|---|---|---|---|---|
| Molar Flow Rate (lbmol/h) | 7,606 | 7,155 | 361 | 1,431 | 1,431 | 1,335 | 186 |
| Mass Flow Rate (lb/h) | 124,018 | 90,141 | 27,102 | 18,028 | 18,028 | 11,973 | 12,831 |
| Temperature (° C.) | 514 | 10 | 10 | 10 | 10 | −3 | −11 |
| Pressure (psia) | 75 | 75 | 70 | 70 | 70 | 70 | 70 |
| Component (mol %) | | | | | | | |
| Hydrogen | 72.3 | 76.8 | 0.5 | 76.8 | 76.8 | 82.3 | 0.5 |
| Methane | 3.2 | 3.4 | 0.1 | 3.4 | 3.4 | 3.6 | 0.1 |
| Ethane | 2.5 | 2.6 | 0.6 | 2.6 | 2.6 | 2.7 | 1.0 |
| Propane | 6.6 | 6.7 | 5.2 | 6.7 | 6.7 | 6.0 | 10.5 |
| Butanes | 7.9 | 7.2 | 19.7 | 7.2 | 7.2 | 4.4 | 32.4 |
| $C_5$ + | 7.5 | 3.2 | 73.8 | 3.2 | 3.2 | 0.9 | 55.3 |
| Component (lb/h) | | | | | | | |
| Hydrogen | 11,081 | 11,076 | 3.6 | 2,215 | 2,215 | 2,214 | 2.0 |
| Methane | 3,927 | 3,920 | 5.6 | 784 | 784 | 782 | 3.9 |
| Ethane | 5,692 | 5,617 | 60.0 | 1,123 | 1,123 | 1,083 | 55.9 |
| Propane | 22,048 | 21,008 | 832 | 4,202 | 4,202 | 3,548 | 862 |
| Butanes | 34,874 | 29,723 | 4,120 | 5,944 | 5,944 | 3,455 | 3,519 |
| $C_5$ + | 46,395 | 18,795 | 22,081 | 3,759 | 3,759 | 891 | 8,387 |

Actual Horsepower = 209 + 1,274 hp

Example 17

The computer calculations were repeated, this time assuming that the process was carried out exactly as shown in FIG. 7, including the membrane loop. As in Example 16, stream 707 was assumed to be a 25% cut of stream 704. Of purge stream 707, 40% was assumed to be sent for membrane treatment via line 709, and 60% was assumed to be sent through line 710 directly to the recontactor.

Membrane pressure-normalized fluxes were assumed to be as follows, as are typical of a silicone rubber membrane:

| | |
|---|---|
| Hydrogen | $150 \times 10^{-6}$ cm$^3$(STP)/cm$^2$ · sec · cmHg |
| Methane | $200 \times 10^{-6}$ cm$^3$(STP)/cm$^2$ · sec · cmHg |
| Ethane | $480 \times 10^{-6}$ cm$^3$(STP)/cm$^2$ · sec · cmHg |
| Propane | $730 \times 10^{-6}$ cm$^3$(STP)/cm$^2$ · sec · cmHg |
| Butanes | $900 \times 10^{-6}$ cm$^3$(STP)/cm$^2$ · sec · cmHg |
| $C_5$+ | $1{,}100 \times 10^{-6}$ cm$^3$(STP)/cm$^2$ · sec · cmHg |

The results of the calculations are shown in Table 16. The stream numbers correspond to FIG. 7.

TABLE 16

| Component/ Parameter | Stream 702 | Stream 704 | Stream 703 | Stream 707 | Stream 709 | Stream 713 | Stream 716 | Stream 717 | Stream 720 | Stream 721 |
|---|---|---|---|---|---|---|---|---|---|---|
| Molar Flow Rate (lbmol/h) | 7,606 | 7,157 | 366 | 1,789 | 727 | 717.5 | 364 | 353 | 1,305 | 213 |
| Mass Flow Rate (lb/h) | 124,018 | 90,254 | 27,500 | 22,563 | 9,161 | 8,550 | 6,683 | 1,867 | 12,547 | 14,414 |
| Temperature (° C.) | 514 | 10 | 50 | 10 | 10 | 38 | 34 | 34 | −1 | −12 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 65.3 | 90.5 | 80.7 | 0.5 |
| Methane | 3.2 | 3.4 | 0.1 | 3.4 | 3.4 | 3.5 | 3.5 | 3.4 | 3.7 | 0.1 |
| Ethane | 2.5 | 2.6 | 0.6 | 2.6 | 2.6 | 2.6 | 3.9 | 1.3 | 3.1 | 1.1 |
| Propane | 6.6 | 6.7 | 5.2 | 6.7 | 6.7 | 6.6 | 10.8 | 2.2 | 6.9 | 11.9 |
| Butanes | 7.9 | 7.2 | 19.7 | 7.2 | 7.2 | 7.0 | 11.7 | 1.9 | 2.8 | 34.8 |
| $C_5$ + | 7.5 | 3.2 | 73.9 | 3.2 | 3.2 | 2.6 | 4.7 | 0.5 | 0.8 | 51.4 |
| Component (lb/h) | | | | | | | | | | |
| Hydrogen | 11,081 | 11,077 | 3.7 | 2,769 | 1,124 | 1,124 | 479 | 644 | 2,123 | 2.3 |
| Methane | 3,927 | 3,290 | 5.6 | 980 | 398 | 397 | 202 | 195 | 781 | 4.6 |
| Ethane | 5,692 | 5,620 | 61 | 1,405 | 570 | 567 | 424 | 143 | 1,201 | 72.4 |
| Propane | 22,048 | 21,032 | 845 | 5,258 | 2,135 | 2,094 | 1,744 | 350 | 3,955 | 1,124 |
| Butanes | 24,873 | 29,789 | 4,189 | 7,447 | 3,023 | 2,870 | 2,487 | 383 | 3,640 | 4,317 |
| $C_5$ + | 46,395 | 18,803 | 22,395 | 4,702 | 1,909 | 1,497 | 1,346 | 150 | 845 | 8,893 |

Membrane Area = 400 m$^2$
Actual Horsepower = 196 + 646 + 1,641 hp

Example 18

The computer calculation of Example 17 was repeated, except that the purge cut was assumed to be 30%, that is, 30% of stream 704 was passed to stream 707 and 70% was returned as stream 708. All other assumptions were as Example 17, including a 60/40 split between streams 710 and 709.

The results of the calculations are shown in Table 17. The stream numbers correspond to FIG. 7.

TABLE 17

| Component/ Parameter | Stream 702 | Stream 704 | Stream 703 | Stream 707 | Stream 709 | Stream 713 | Stream 716 | Stream 717 | Stream 720 | Stream 721 |
|---|---|---|---|---|---|---|---|---|---|---|
| Molar Flow Rate (lbmol/h) | 7,606 | 7,159 | 369 | 2,148 | 1,111 | 1,098 | 384 | 714 | 1,283 | 229 |
| Mass Flow Rate (lb/h) | 124,018 | 90,314 | 27,712 | 27,094 | 14,021 | 13,086 | 7,983 | 5,103 | 12,641 | 15,343 |
| Temperature (° C.) | 514 | 10 | 10 | 10 | 10 | 38 | 35 | 35 | −1 | −12 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 60.8 | 86.8 | 80.1 | 0.5 |
| Methane | 3.2 | 3.4 | 0.1 | 3.4 | 3.4 | 3.5 | 3.3 | 3.5 | 3.7 | 0.1 |
| Ethane | 2.5 | 2.6 | 0.6 | 2.6 | 2.6 | 2.6 | 4.1 | 1.8 | 3.2 | 1.2 |
| Propane | 6.6 | 6.7 | 5.2 | 6.7 | 6.7 | 6.6 | 12.3 | 3.6 | 7.2 | 12.5 |
| Butanes | 7.9 | 7.2 | 19.6 | 7.2 | 7.2 | 6.9 | 13.6 | 3.2 | 4.9 | 35.6 |
| $C_5$ + | 7.5 | 3.2 | 73.8 | 3.2 | 3.2 | 2.7 | 5.7 | 1.1 | 0.9 | 49.8 |
| Component (lb/h) | | | | | | | | | | |
| Hydrogen | 11,081 | 11,077 | 3.7 | 3,322 | 1,720 | 1,719 | 470 | 1,249 | 2,072 | 2.5 |
| Methane | 3,927 | 3,921 | 5.7 | 1,176 | 609 | 608 | 204 | 404 | 768 | 5.0 |

TABLE 17-continued

| Component/ Parameter | Stream 702 | Stream 704 | Stream 703 | Stream 707 | Stream 709 | Stream 713 | Stream 716 | Stream 717 | Stream 720 | Stream 721 |
|---|---|---|---|---|---|---|---|---|---|---|
| Ethane | 5,692 | 5,621 | 61.4 | 1,686 | 873 | 867 | 478 | 389 | 1,227 | 80.5 |
| Propane | 22,048 | 21,045 | 852 | 6,314 | 3,267 | 3,205 | 2,080 | 1,124 | 4,076 | 1,264 |
| Butanes | 24,873 | 29,824 | 4,226 | 8,947 | 4,630 | 4,396 | 3,047 | 1,348 | 3,675 | 4,744 |
| $C_5$ + | 46,395 | 18,825 | 22,562 | 5,647 | 2,923 | 2,291 | 1,702 | 588 | 820 | 9,245 |

Membrane Area = 400 $m^2$
Actual Horsepower = 183 + 989 + 1,628 hp

Example 19

The computer calculation of Example 17 was repeated, except that the purge cut was assumed to be 35%, that is, 35% of stream 704 was passed to stream 707 and 65% was returned as stream 708. All other assumptions were as Example 17, including a 60/40 split between streams 710 and 709.

The results of the calculations are shown in Table 18. The stream numbers correspond to FIG. 7.

TABLE 18

| Component/ Parameter | Stream 702 | Stream 704 | Stream 703 | Stream 707 | Stream 709 | Stream 713 | Stream 716 | Stream 717 | Stream 720 | Stream 721 |
|---|---|---|---|---|---|---|---|---|---|---|
| Molar Flow Rate (lbmol/h) | 7,606 | 7,160 | 371 | 2,506 | 1,479 | 1,460 | 394 | 1,066 | 1,276 | 238 |
| Mass Flow Rate (lb/h) | 124,018 | 90,372 | 27,914 | 31,630 | 18,662 | 17,415 | 8,688 | 8,727 | 12,720 | 15,915 |
| Temperature (° C.) | 514 | 10 | 10 | 10 | 10 | 38 | 35 | 35 | 0 | −12 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 58.6 | 84.7 | 79.8 | 0.5 |
| Methane | 3.2 | 3.4 | 0.1 | 3.4 | 3.4 | 3.5 | 3.2 | 3.5 | 3.7 | 0.1 |
| Ethane | 2.5 | 2.6 | 0.6 | 2.6 | 2.6 | 2.6 | 4.3 | 2 | 3.2 | 1.2 |
| Propane | 6.6 | 6.7 | 5.2 | 6.7 | 6.7 | 6.9 | 13 | 4.3 | 7.4 | 12.8 |
| Butanes | 7.9 | 7.2 | 19.7 | 7.2 | 7.2 | 6.9 | 14.6 | 4 | 4.9 | 36.1 |
| $C_5$ + | 7.5 | 3.2 | 73.8 | 3.2 | 3.2 | 2.7 | 6.2 | 1.4 | 1.0 | 49.2 |
| Component (lb/h) | | | | | | | | | | |
| Hydrogen | 11,081 | 11,077 | 3.7 | 3,877 | 2,287 | 2,286 | 466 | 1,821 | 2,054 | 2.6 |
| Methane | 3,927 | 394 | 5.7 | 1,372 | 810 | 809 | 205 | 604 | 764 | 5.2 |
| Ethane | 5,692 | 5,623 | 61.8 | 1,968 | 1,161 | 1,153 | 504 | 650 | 1,241 | 85.2 |
| Propane | 22,048 | 21,058 | 859 | 7,370 | 4,348 | 4,265 | 2,255 | 2,010 | 4,146 | 1,345 |
| Butanes | 24,873 | 29,859 | 4,261 | 10,450 | 6,165 | 5,854 | 3,353 | 2,500 | 3,704 | 4,999 |
| $C_5$ + | 46,395 | 18,834 | 22,722 | 6,591 | 3,889 | 3,048 | 1,905 | 1,143 | 810 | 9,478 |

Membrane Area = 400 $m^2$
Actual Horsepower = 170 + 1,315 + 1,629 hp

Example 20

A computer calculation was performed to simulate the prior art, no-membrane case, but this time the recontactor is a seven-stage column, rather than a single-stage contact vessel. For this non-membrane case, as for Example 16, all of purge stream 707 was assumed to pass to the recontactor. All other assumptions were as in Example 16.

The results of the calculations are shown in Table 19. The stream numbers correspond to FIG. 7.

TABLE 19

| Component/ Parameter | Stream 702 | Stream 704 | Stream 703 | Stream 707 | Stream 710 | Stream 720 | Stream 721 |
|---|---|---|---|---|---|---|---|
| Molar Flow Rate (lbmol/h) | 7,606 | 7,155 | 361 | 1,431 | 1,431 | 1,277 | 244 |
| Mass Flow Rate (lb/h) | 124,018 | 90,141 | 27,102 | 18,028 | 18,028 | 8,891 | 15,913 |

TABLE 19-continued

| Component/ Parameter | Stream 702 | Stream 704 | Stream 703 | Stream 707 | Stream 710 | Stream 720 | Stream 721 |
|---|---|---|---|---|---|---|---|
| Temperature (° C.) | 950 | 50 | 50 | 50 | 50 | 21 | −15 |
| Pressure (psia) | 75 | 75 | 70 | 70 | 70 | 70 | 70 |
| Component (mol %) | | | | | | | |
| Hydrogen | 72.3 | 76.8 | 0.5 | 76.8 | 76.8 | 86.0 | 0.6 |
| Methane | 3.2 | 3.4 | 0.1 | 3.4 | 3.4 | 3.8 | 0.2 |
| Ethane | 2.5 | 2.6 | 0.6 | 2.6 | 2.6 | 2.7 | 1.4 |
| Propane | 6.6 | 6.7 | 5.2 | 6.7 | 6.7 | 4.8 | 15.9 |
| Butanes | 7.9 | 7.2 | 19.7 | 7.2 | 7.2 | 2.0 | 38.4 |
| $C_5$ + | 7.5 | 3.2 | 73.8 | 3.2 | 3.2 | 0.6 | 43.4 |
| Component (lb/h) | | | | | | | |
| Hydrogen | 11,081 | 11,076 | 3.6 | 2,215 | 2,215 | 2,213 | 2.8 |
| Methane | 3,927 | 3,920 | 5.6 | 784 | 784 | 779 | 6.2 |
| Ethane | 5,692 | 5,617 | 60.0 | 1,123 | 1,123 | 1,033 | 106 |
| Propane | 22,048 | 21,008 | 832 | 4,202 | 4,202 | 2,700 | 1,710 |
| Butanes | 24,873 | 29,724 | 4,120 | 5,945 | 5,945 | 1,508 | 5,460 |
| $C_5$ + | 46,395 | 18,795 | 22,080 | 3,759 | 3,759 | 657 | 8,622 |

Actual Horsepower = 209 + 1,273 hp

Example 21

The computer calculations of Example 20 were repeated, this time assuming that the process was carried out exactly as shown in FIG. 7, including the membrane loop. As in Example 20, stream 707 was assumed to be a 25% cut of stream 704. Of purge stream 707, 40% was assumed to be sent for membrane treatment via line 709, and 60% was assumed to be sent through line 710 directly to the recontactor.

Membrane pressure-normalized fluxes were assumed to be as follows, as are typical of a silicone rubber membrane:

| | |
|---|---|
| Hydrogen | $150 \times 10^{-6}$ cm$^3$(STP)/cm$^2$ · sec · cmHg |
| Methane | $200 \times 10^{-6}$ cm$^3$(STP)/cm$^2$ · sec · cmHg |
| Ethane | $480 \times 10^{-6}$ cm$^3$(STP)/cm$^2$ · sec · cmHg |
| Propane | $730 \times 10^{-6}$ cm$^3$(STP)/cm$^2$ · sec · cmHg |
| Butanes | $900 \times 10^{-6}$ cm$^3$(STP)/cm$^2$ · sec · cmHg |
| $C_5$+ | $1{,}100 \times 10^{-6}$ cm$^3$(STP)/cm$^2$ · sec · cmHg |

The results of the calculations are shown in Table 20. The stream numbers correspond to FIG. 7.

TABLE 20

| Component/ Parameter | Stream 702 | Stream 704 | Stream 703 | Stream 707 | Stream 709 | Stream 713 | Stream 716 | Stream 717 | Stream 720 | Stream 721 |
|---|---|---|---|---|---|---|---|---|---|---|
| Molar Flow Rate (lbmol/h) | 7,606 | 7,158 | 366 | 1,789 | 727 | 717.5 | 364 | 353 | 1,237 | 281 |
| Mass Flow Rate (lb/h) | 124,018 | 90,254 | 27,500 | 22,563 | 9,161 | 8,550 | 6,683 | 1,867 | 9,014 | 17,947 |
| Temperature (° C.) | 514 | 10 | 10 | 10 | 10 | 38 | 34 | 34 | −3 | −27 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 65.3 | 90.5 | 85.1 | 0.6 |
| Methane | 3.2 | 3.4 | 0.1 | 3.4 | 3.4 | 3.5 | 3.5 | 3.5 | 3.9 | 0.2 |
| Ethane | 2.5 | 2.6 | 0.6 | 2.6 | 2.6 | 2.6 | 3.9 | 1.4 | 3.1 | 1.6 |
| Propane | 6.6 | 6.7 | 5.2 | 6.7 | 6.7 | 6.6 | 10.9 | 2.2 | 5.2 | 17.9 |
| Butanes | 7.9 | 7.2 | 19.7 | 7.2 | 7.2 | 7.0 | 11.7 | 1.9 | 2.0 | 39.7 |
| $C_5$ + | 7.5 | 3.2 | 73.8 | 3.2 | 3.2 | 2.6 | 4.7 | 0.5 | 0.7 | 40.0 |
| Component (lb/h) | | | | | | | | | | |
| Hydrogen | 11,081 | 11,077 | 3.7 | 2,769 | 1,124 | 1,124 | 479 | 644 | 2,122 | 3.2 |
| Methane | 3,927 | 3,921 | 5.6 | 980 | 398 | 397 | 202 | 195 | 778 | 7.4 |
| Ethane | 5,692 | 5,620 | 60.9 | 1,405 | 570 | 567 | 424 | 143 | 1,134 | 139 |
| Propane | 22,048 | 21,032 | 845 | 5,258 | 2,165 | 2,094 | 1,744 | 350 | 2,858 | 2,221 |
| Butanes | 24,873 | 29,790 | 4,189 | 7,447 | 3,024 | 2,870 | 2,487 | 384 | 1,468 | 6,490 |
| $C_5$ + | 46,395 | 18,814 | 22,395 | 4,704 | 1,909 | 1,497 | 1,346 | 151 | 653 | 9,046 |

Membrane Area = 400 m$^2$
Actual Horsepower = 196 + 646 + 1,641 hp

Example 22

The computer calculation of Example 21 was repeated, except that the purge cut, stream 707, was assumed to be 30% of stream 704. The feed flow rate, feed stream composition, and all other operating conditions were as in Example 20. Membrane pressure-normalized fluxes were assumed to be as in Example 21.

The results of the calculations are shown in Table 21. The stream numbers correspond to FIG. 7.

TABLE 21

| Component/ Parameter | Stream 702 | Stream 704 | Stream 703 | Stream 707 | Stream 709 | Stream 713 | Stream 716 | Stream 717 | Stream 720 | Stream 721 |
|---|---|---|---|---|---|---|---|---|---|---|
| Molar Flow Rate (lbmol/h) | 7,606 | 7,159 | 369 | 2,148 | 1,111 | 1,098 | 384 | 714 | 1,212 | 300 |
| Mass Flow Rate (lb/h) | 124,018 | 90,314 | 27,712 | 27,094 | 14,022 | 13,086 | 7,983 | 5,103 | 8,961 | 19,022 |
| Temperature (° C.) | 514 | 10 | 10 | 10 | 10 | 38 | 35 | 35 | −2 | −28 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 60.8 | 86.8 | 84.8 | 0.6 |
| Methane | 3.2 | 3.4 | 0.1 | 3.4 | 3.4 | 3.5 | 3.3 | 3.5 | 3.9 | 0.2 |
| Ethane | 2.5 | 2.6 | 0.6 | 2.6 | 2.6 | 2.6 | 4.1 | 1.8 | 3.2 | 1.7 |
| Propane | 6.6 | 6.7 | 5.2 | 6.7 | 6.7 | 6.6 | 12.3 | 3.6 | 5.4 | 18.6 |
| Butanes | 7.9 | 7.2 | 19.7 | 7.2 | 7.2 | 6.9 | 13.6 | 3.2 | 2.0 | 40.0 |
| $C_5$ + | 7.5 | 3.2 | 73.8 | 3.2 | 3.2 | 2.7 | 0.7 | 1.1 | 0.7 | 38.9 |
| Component (lb/h) | | | | | | | | | | |
| Hydrogen | 11,081 | 11,077 | 3.7 | 3,322 | 1,720 | 1,719 | 470 | 1,249 | 2,071 | 3.4 |
| Methane | 3,927 | 3,921 | 5.7 | 1,176 | 609 | 608 | 204 | 404 | 765 | 8.0 |
| Ethane | 5,692 | 5,621 | 61.4 | 1,686 | 873 | 867 | 478 | 389 | 1,153 | 154 |
| Propane | 22,048 | 21,045 | 852 | 6,314 | 3,267 | 3,205 | 2,080 | 1,124 | 2,880 | 2,460 |
| Butanes | 24,873 | 29,824 | 4,226 | 8,947 | 4,630 | 4,396 | 3,047 | 1,348 | 1,443 | 6,978 |
| $C_5$ + | 46,395 | 18,825 | 22,562 | 5,647 | 2,923 | 2,291 | 1,702 | 588 | 649 | 9,419 |

Membrane Area = 400 $m^2$
Actual Horsepower = 183 + 989 + 1,628 hp

Example 23

The computer calculation of Example 22 was repeated, except that the purge cut, stream 707, was assumed to be 35% of stream 704. The feed flow rate, feed stream composition, and all other operating conditions were as in Example 20. Membrane pressure-normalized fluxes were assumed to be as in Example 21.

The results of the calculations are shown in Table 22. The stream numbers correspond to FIG. 7.

TABLE 22

| Component/ Parameter | Stream 702 | Stream 704 | Stream 703 | Stream 707 | Stream 709 | Stream 713 | Stream 716 | Stream 717 | Stream 720 | Stream 721 |
|---|---|---|---|---|---|---|---|---|---|---|
| Molar Flow Rate (lbmol/h) | 7,606 | 7,160 | 372 | 2,506 | 1,479 | 1,460 | 394 | 1,066 | 1,203 | 311 |
| Mass Flow Rate (lb/h) | 124,018 | 90,372 | 27,914 | 31,630 | 18,662 | 17,415 | 8,688 | 8,727 | 8,960 | 19,675 |
| Temperature (° C.) | 514 | 10 | 10 | 10 | 10 | 38 | 35 | 35 | −1 | −28 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 58.6 | 84.7 | 84.6 | 0.6 |
| Methane | 3.2 | 3.4 | 0.1 | 3.4 | 3.4 | 3.5 | 3.2 | 3.5 | 3.9 | 0.2 |
| Ethane | 2.5 | 2.6 | 0.6 | 2.6 | 2.6 | 2.6 | 4.3 | 2.0 | 3.2 | 1.7 |
| Propane | 6.6 | 6.7 | 5.2 | 6.7 | 6.7 | 6.9 | 13.0 | 4.3 | 5.5 | 18.9 |
| Butanes | 7.9 | 7.2 | 19.7 | 7.2 | 7.2 | 6.9 | 14.6 | 4.0 | 2.0 | 30.2 |
| $C_5$ + | 7.5 | 3.2 | 73.8 | 3.2 | 3.2 | 2.7 | 6.2 | 1.4 | 0.7 | 38.4 |
| Component (lb/h) | | | | | | | | | | |
| Hydrogen | 11,081 | 11,077 | 3.7 | 3,877 | 2,287 | 2,286 | 466 | 1,821 | 2,054 | 3.5 |
| Methane | 3,927 | 3,924 | 5.7 | 1,372 | 810 | 809 | 205 | 604 | 761 | 8.3 |
| Ethane | 5,692 | 5,623 | 61.8 | 1,968 | 1,161 | 1,153 | 504 | 650 | 1,163 | 163 |
| Propane | 22,048 | 21,058 | 859 | 7,370 | 4,348 | 4,265 | 2,255 | 2,010 | 2,897 | 2,595 |
| Butanes | 24,873 | 29,859 | 4,261 | 10,450 | 6,165 | 5,854 | 3,353 | 2,500 | 1,438 | 7,265 |
| $C_5$ + | 46,395 | 18,834 | 22,722 | 6,591 | 3,889 | 3,048 | 1,905 | 1,143 | 649 | 9,641 |

Membrane Area = 400 $m^2$
Actual Horsepower = 170 + 1,315 + 1,629 hp

Example 24

Comparison of Examples 16–23

The reformate liquid recovery and the concentration of hydrogen in the hydrogen recycle stream and the final purge gas stream were compared for the calculations of Examples 16–23. The results are shown in Table 23.

TABLE 23

| Recontactor Type | Example # | Recycle/Purge Split (mol %) | Total Liquid Product Recovered (Stream 703 + 721) (lb/h) | $H_2$ Concentration in Recycle (Stream 718) (mol %) | $H_2$ Concentration in Product (Stream 720) (mol %) |
|---|---|---|---|---|---|
| single-stage | 16 (no membrane) | 75/25 | 30,468 | 76.8 | 82.3 |
| | 17 | 75/25 | 31,288 | 77.6 | 80.7 |
| | 18 | 70/30 | 31,807 | 78.0 | 80.1 |
| | 19 | 65/35 | 32,200 | 78.2 | 79.8 |
| multi-stage | 20 (no membrane) | 75/25 | 30,702 | 76.8 | 86.0 |
| | 21 | 75/25 | 31,481 | 77.6 | 85.1 |
| | 22 | 70/30 | 31,976 | 78.0 | 84.8 |
| | 23 | 65/35 | 32,363 | 78.2 | 84.6 |

For all examples of the invention, the percentage split between the portions of the purge treated in the membrane loop and passed untreated to the recontactor was 40/60. As a larger percentage of the first separator overhead stream is purged and passed through the membrane treatment, more total reformate liquid products are produced. For example, taking a purge cut of 25%, and then membrane treating 40% of this, yields 31,288 lb/h of reformate, compared with 30,468 lb/h for the prior art case, an increased yield of 820 lb/h, or over 7 million lb annually. If a higher purge cut is taken, and a multi-stage recontactor is used, the yield can be raised as high as 32,363 lb/h, for an annual increased yield of over 16 million lb.

The addition of the hydrogen-enriched residue stream, 717, to the hydrogen recycle stream, 708, produces a higher hydrogen concentration in the combined recycle stream, 718, being introduced to the reformer. Even very small increases, such as the 0.8–1.4% increase from the 76.8% in stream 708, can be significant in prolonging the life of the reformer catalyst and in reducing the formation of non-preferred, low-value products.

We claim:

1. A process for use in a refinery, petrochemical plant or the like, comprising providing selective purging of light hydrocarbons from a reactor recycle loop by carrying out the following steps:

(a) withdrawing an effluent stream comprising hydrogen and hydrocarbons from a reactor in the reactor recycle loop;

(b) separating a vapor phase comprising hydrogen and light hydrocarbons, including a $C_{4+}$ hydrocarbon, from the effluent stream;

(c) passing at least a portion of the vapor phase as a feed stream across the feed side of a polymeric membrane having a feed side and permeate side, and being selective for the $C_{4+}$ hydrocarbon over hydrogen;

(d) withdrawing from the permeate side a permeate stream enriched in the $C_{4+}$ hydrocarbon compared with the vapor phase;

(e) withdrawing from the feed side a residue stream enriched in hydrogen compared with the vapor phase;

(f) completing the reactor recycle loop by recirculating at least a portion of the residue stream to the reactor.

2. The process of claim 1, wherein the separating step (b) comprises cooling at least a portion of the effluent stream.

3. The process of claim 2, wherein the cooling is performed in multiple stages.

4. The process of claim 1, wherein the separating step (b) comprises pressure reduction of the effluent stream.

5. The process of claim 1, wherein the polymeric membrane comprises silicone rubber.

6. The process of claim 1, wherein the polymeric membrane comprises a super-glassy polymer.

7. The process of claim 1, wherein the polymeric membrane comprises a polyamide-polyether block copolymer.

8. The process of claim 1, wherein the reactor comprises a hydrotreater.

9. The process of claim 1, wherein the reactor comprises a hydrocracker.

10. The process of claim 1, wherein the reactor comprises an isomerization unit.

11. The process of claim 1, wherein the reactor comprises a catalytic reformer.

12. The process of claim 1, wherein the reactor comprises a hydrodealkylation unit.

13. The process of claim 1, wherein the light hydrocarbons further include methane.

14. The process of claim 1, wherein the light hydrocarbons further include ethane.

15. The process of claim 1, wherein the light hydrocarbons further include a $C_{3+}$ hydrocarbon.

16. The process of claim 1, further comprising compressing the feed stream prior to passing the feed stream across the feed side.

17. The process of claim 16, wherein the compressing results in condensation of a liquid hydrocarbon fraction and wherein the liquid hydrocarbon fraction is removed from the feed stream prior to passing the feed stream across the feed side.

18. The process of claim 1, wherein the permeate stream is subjected to further separation treatment.

19. The process of claim 1, wherein the permeate stream is recirculated to the separating step (b).

20. The process of claim 1, wherein the effluent stream contains hydrogen sulfide.

21. The process of claim 20, further comprising treatment to remove at least a part of the hydrogen sulfide from the effluent stream.

22. The process of claim 1, wherein the permeate stream has a hydrogen concentration at least about 1.5 times lower than the feed stream.

23. The process of claim 1, wherein the permeate stream has a hydrogen concentration at least about 2 times lower than the feed stream.

24. The process of claim 1, wherein the residue stream has a hydrogen concentration no more than 5% higher than the feed stream.

25. The process of claim 1, wherein the residue stream has a hydrogen concentration no more than 2% higher than the feed stream.

26. The process of claim 1, wherein the portion of the residue stream is recirculated to the reactor loop without recompression.

27. A process for use in a refinery, petrochemical plant or the like, comprising providing selective purging of hydrogen sulfide from a reactor recycle loop by carrying out the following steps:

(a) withdrawing an effluent stream comprising hydrogen, hydrogen sulfide and hydrocarbons from a reactor in the reactor recycle loop;

(b) separating a vapor phase comprising hydrogen, hydrogen sulfide and light hydrocarbons, including a $C_{4+}$ hydrocarbon, from the effluent stream;

(c) passing at least a portion of the vapor phase as a feed stream across the feed side of a polymeric membrane having a feed side and permeate side, and being selective for the $C_{4+}$ hydrocarbon over hydrogen;

(d) withdrawing from the permeate side a permeate stream enriched in the $C_{4+}$ hydrocarbon and hydrogen sulfide compared with the vapor phase;

(e) withdrawing from the feed side a residue stream enriched in hydrogen compared with the vapor phase;

(f) completing the reactor recycle loop by recirculating at least a portion of the residue stream to the reactor.

28. The process of claim 27, wherein the polymeric membrane comprises silicone rubber.

29. The process of claim 27, wherein the polymeric membrane comprises a polyamide-polyether block copolymer.

30. The process of claim 27, wherein the reactor comprises a hydrotreater.

31. The process of claim 27, wherein the permeate stream is recirculated to the separating step (b).

32. The process of claim 27, further comprising treatment to remove at least a part of the hydrogen sulfide from the effluent stream.

33. The process of claim 32, wherein the treatment comprises water washing.

34. The process of claim 32, wherein the treatment comprises amine scrubbing.

35. The process of claim 27, wherein the permeate stream has a hydrogen concentration at least about 2 times lower than the feed stream.

36. The process of claim 27, wherein the residue stream has a hydrogen concentration no more than 5% higher than the feed stream.

37. A process for use in a refinery, petrochemical plant or the like, comprising the following steps:

(a) withdrawing an effluent stream comprising hydrogen and hydrocarbons from a reactor;

(b) separating a vapor phase comprising hydrogen and a light hydrocarbon from the effluent stream;

(c) passing at least a portion of the vapor phase as a feed stream across the feed side of a polymeric membrane having a feed side and permeate side, and being selective for the light hydrocarbon over hydrogen;

(d) withdrawing from the permeate side a permeate stream enriched in the light hydrocarbon compared with the vapor phase;

(e) withdrawing from the feed side a residue stream enriched in hydrogen compared with the vapor phase;

(f) recirculating at least a portion of the residue stream to the reactor;

the process being characterized in that steps (c), (d) and (e) are carried out at a stage cut no greater than 50%.

* * * * *